US008814159B2

(12) United States Patent
Kadowaki

(10) Patent No.: US 8,814,159 B2
(45) Date of Patent: Aug. 26, 2014

(54) FEEDING DEVICE AND IMAGE FORMING APPARATUS

(75) Inventor: Noriyuki Kadowaki, Miyagi-Pref. (JP)

(73) Assignee: Ricoh Company, Limited, Tokyo (JP)

( * ) Notice: Subject to any disclaimer, the term of this patent is extended or adjusted under 35 U.S.C. 154(b) by 32 days.

(21) Appl. No.: 12/929,653

(22) Filed: Feb. 7, 2011

(65) Prior Publication Data

US 2011/0193285 A1 Aug. 11, 2011

(30) Foreign Application Priority Data

Feb. 10, 2010 (JP) ..... 2010-027762

(51) Int. Cl.
*B65H 3/12* (2006.01)

(52) U.S. Cl.
USPC ..... 271/94; 271/97

(58) Field of Classification Search
USPC ..... 271/3.22, 3.23, 5, 11, 90–98
See application file for complete search history.

(56) References Cited

U.S. PATENT DOCUMENTS

| | | | | |
|---|---|---|---|---|
| 3,025,052 | A * | 3/1962 | Gutteling | 271/94 |
| 3,595,563 | A * | 7/1971 | Rostoker et al. | 271/96 |
| 4,345,752 | A * | 8/1982 | Nakamura et al. | 271/12 |
| 4,566,683 | A * | 1/1986 | Moore | 271/98 |
| 6,254,079 | B1 * | 7/2001 | Suzuki et al. | 271/10.1 |

FOREIGN PATENT DOCUMENTS

| | | | |
|---|---|---|---|
| EP | 047937 | * | 3/1982 |
| JP | 56-122739 | * | 9/1981 |
| JP | 58-197137 | * | 11/1983 |
| JP | 61-254438 | | 11/1986 |
| JP | 63-57448 | * | 3/1988 |
| JP | 2934442 | A | 3/1990 |
| JP | 5-178498 | * | 7/1993 |
| JP | 07101575 | A | 4/1995 |
| JP | 11-079422 | | 3/1999 |
| JP | 3559437 | A | 7/1999 |
| JP | 2000103535 | A | 4/2000 |
| JP | 2000177870 | A | 6/2000 |
| JP | 3959629 | A | 3/2004 |
| JP | 2004224505 | A | 8/2004 |
| JP | 2006016159 | A | 1/2006 |
| JP | 4495637 | A | 12/2006 |

(Continued)

OTHER PUBLICATIONS

Machine translation of the Detailed Description section of JP 2009-208858.*
Machine translation of Detailed Description section of JP 5-178498.*
Machine translation of Detailed Description section of JP 2007-45630.*
JP-2007-045630 corresponds to JP 4516504, (2007-045630 dated Feb. 2007).
JP-H11-184171 corresponds to JP 3559437, (11-184171 dated Jul. 1999).

(Continued)

*Primary Examiner* — Thomas Morrison
(74) *Attorney, Agent, or Firm* — Harness, Dickey & Pierce, P.L.C.

(57) ABSTRACT

A feeding device includes: a sheet material housing configured to allow a plurality of sheet materials to be stacked; an upper surface suction unit that sucks a top sheet material by generating negative pressure at a position facing the upper surface of the top sheet material; a sheet material conveying unit that causes the top sheet material, which is sucked up, to be sucked onto a conveying member and conveys the top sheet material; and a lower suction unit that exerts a suction force downward onto the sheet materials that are positioned near the top sheet material, wherein a suction force exerted on the top sheet material downward by suction of the lower suction unit is smaller than a suction force exerted on the top sheet material upward by suction of the upper surface suction unit and is larger than adhesion between the sheet materials.

9 Claims, 18 Drawing Sheets

(56) References Cited

FOREIGN PATENT DOCUMENTS

| | | | | |
|---|---|---|---|---|
| JP | 2007-45630 | | * | 2/2007 |
| JP | 4516504 | A | | 2/2007 |
| JP | 2007331905 | A | | 12/2007 |
| JP | 2008308303 | A | | 12/2008 |
| JP | 2009190840 | A | | 8/2009 |
| JP | 2009-208858 | | * | 9/2009 |
| JP | 2009203072 | A | | 9/2009 |
| JP | 2010089955 | A | | 4/2010 |

OTHER PUBLICATIONS

JP-2004-075201 corresponds to JP 3959629 ( 2004-075201 dated Mar. 2004).

JP-2006-327778 corresponds to JP 4495637 (2006-327778 dated Dec. 2006).

JP-H02-081838 corresponds to JP 2934442, (2-081838 dated Mar. 1990).

Office Action dated Oct. 19, 2013 for corresponding Japanese patent application No. 2010-027762.

* cited by examiner

RELATED ART

RELATED ART

RELATED ART

RELATED ART

RELATED ART

RELATED ART

RELATED ART

RELATED ART

FEEDING DEVICE AND IMAGE FORMING APPARATUS

CROSS-REFERENCE TO RELATED APPLICATIONS

The present application claims priority to and incorporates by reference the entire contents of Japanese Patent Application No. 2010-027762 filed in Japan on Feb. 10, 2010.

BACKGROUND OF THE INVENTION

1. Field of the Invention

The present invention relates to a feeding device that is included in an image forming apparatus, such as a copying machine, a facsimile, and a printer. More particularly, the present invention relates to a feeding device that causes a conveying member to suck the top sheet material out of sheet materials which are stacked in a sheet material housing and feeds the sucked sheet material to the following process, and an image forming apparatus including the feeding device.

2. Description of the Related Art

In a feeding device that is included in an image forming apparatus or the like, it is important to send a plurality of sheet materials such as recording sheets stacked in a sheet material housing accurately one by one. Therefore, the feeding device needs to include a separating mechanism for separating the stacked sheet materials one by one. A widely used separating mechanism is a friction separation type separating mechanism that separates and feeds sheet materials which are sent from the sheet material housing by a pick-up roller, based on a frictional force. The combination of a separating roller and a friction pad, the combination of a separating roller and a reverse roller, or the like is used as a friction separation type separating mechanism.

As a feeding device that includes a separating mechanism different from the friction separation type separating mechanism, Japanese Patent Application Laid-open No. 2007-45630 and Japanese Patent Application Laid-open No. 07-101575 disclose a feeding device that separates and feeds sheet materials by causing a conveying member to suck the sheet material thereto by generating negative pressure. There will be described below the outline of an example of the feeding device which separates and feeds sheet materials by causing a conveying member to suck the sheet material thereto.

A feeding device 200 shown in FIG. 11 includes a sheet-feed tray 6 and a suction belt 2. The sheet-feed tray 6 is a sheet material housing in which a plurality of sheets P, sheet materials, are stacked in a substantially horizontal manner. On the other hand, the suction belt 2 is a conveying member and is provided with an upper surface suction unit 40 inside thereof.

When a command to start feeding of a sheet is issued against the feeding device 200 from a control unit of an image forming apparatus (not shown), blowing units 1 start to blow air and the upper surface suction unit 40 starts to suck air while driving of the suction belt 2 is stopped as shown in FIG. 12. When the blowing unit 1 start to blow air, air is blown to the front end portion and the side end portion of each of the sheets P as shown by arrows A1 and A2. Accordingly, air is introduced between the sheets P, so that a top sheet P1 of the stacked sheets P floats. When the upper surface suction unit 40 starts to suck air, negative pressure is produced as shown by an arrow B of FIG. 11, so that the floating top sheet P1 is sucked onto the suction belt 2.

When a predetermined time (for example, three seconds) has passed since starting of the blowing operation by the blowing units 1 and the suction operation by the upper surface suction unit 40, the suction belt 2 and a pair of conveying rollers 8 start to operate while the blowing units 1 and the upper surface suction unit 40 are operating as shown in FIG. 13. The suction belt 2 is driven and thus the surface of the suction belt moves in a direction of an arrow C in FIG. 13, so that the top sheet P1 sucked onto the lower surface of the suction belt 2 is conveyed to the downstream side in the sheet feeding direction and reaches the pair of conveying rollers 8. After that, the pair of conveying rollers 8 is rotated in the directions of arrows G in FIG. 13, so that the top sheet P1 is conveyed in a direction of an arrow D in FIG. 11 and reaches an image forming section corresponding to the following process. Then, an image is formed on the top sheet.

When the front end of the top sheet P1, which is conveyed by the suction belt 2 and the pair of conveying rollers 8, is detected by a sheet feed sensor 9 as shown in FIG. 14, the driving of the suction belt 2 is stopped. When the driving of the suction belt 2 is stopped in the state in which the upper surface suction unit 40 is operating, a force for stopping conveyance is applied to a portion of the top sheet P1 sucked onto the suction belt 2. However, the material, the nip pressure, or the like of the pair of conveying rollers 8 is set in the feeding device 200 so that a conveying force which is applied to the sheet P by the pair of conveying rollers 8 is sufficiently larger than the force for stopping conveyance. For this reason, even though the driving of the suction belt 2 is stopped, the top sheet P1 continues to be conveyed by the pair of conveying rollers 8.

Here, a sheet, which is stacked under the top sheet P1 of the sheets P, is referred to as the next top sheet P2. While the top sheet P1 is sucked onto the suction belt 2 as shown in FIGS. 12 to 14, the front end portion of the next top sheet P2 is flapped below the top sheet P1 due to the air blown from the blowing units 1. Accordingly, the front end of the next top sheet P2 is separated from the sheet P that is positioned below the next top sheet.

Subsequently, immediately after the rear end portion of the top sheet P1 passes through the suction area formed by the upper surface suction unit 40, the next top sheet P2 is caused to float by the flow of air, which is formed between the upper surface suction unit 40 and the blowing units 1, as shown in FIG. 15, and is sucked onto the suction belt 2.

Then, after a predetermined time has passed since the sheet feed sensor 9 detects the front end of the top sheet P1 shown in FIG. 14, the suction belt 2 starts to be driven again according to a sheet feeding interval which is set. Accordingly, in a similar manner to the top sheet P1 shown in FIG. 13, the next top sheet P2 is conveyed to the downstream side in the sheet feeding direction by the suction belt 2, reaches the pair of conveying rollers 8, and is further conveyed to the further downstream side by the pair of conveying rollers 8.

After that, if the on/off control of the driving of the suction belt 2 is performed while the blowing units 1, the upper surface suction unit 40, and the pair of conveying rollers 8 are operating, the operations of FIGS. 13 to 15 are repeated and the sheets P are sequentially fed to the image forming section one by one.

The blowing unit 1 not only makes the top sheet P1 float but also separates the front end portions of the sheets P from each other by flowing air into a gap between the sheets P. Since the top sheet P1 of the sheets P of which the front end portions are separated from each other is sucked onto the suction belt 2 and conveyed, it may be possible to separate the top sheet P1 from the other sheets P and to feed only the top sheet P1.

Further, the feeding device 200 includes a sheet upper surface sensor 3, which detects the height of the upper surface of the top sheet P1, to maintain a distance h between the lower surface of the suction belt 2 and the upper surface of the top sheet P1 of the sheets P, which are stacked in the sheet-feed tray 6 and decrease in number due to the feeding of the sheets, within a constant range. A lifting mechanism 150 which moves a bottom plate 61 of the sheet-feed tray 6 up and down is controlled on the basis of the detection signal from the sheet upper surface sensor 3. Accordingly, the height of the bottom plate 61 is adjusted, and the distance h between the lower surface of the suction belt 2 and the upper surface of the top sheet P1 of the sheets P stacked on the bottom plate 61 is controlled so as to be kept within a constant range.

The pair of conveying rollers 8 is disposed on the downstream side of the suction belt 2 in the sheet feeding direction, and further conveys the sheet P, which has been conveyed by the suction belt 2 and reached the two conveying rollers, to the further downstream side. Moreover, the sheet feed sensor 9, which detects the passing of the sheet P, is provided on the downstream side of the pair of conveying rollers 8 in the sheet feeding direction.

In a feeding device which separates and feeds sheets P while a sheet P is sucked onto a suction belt 2, like the above-mentioned feeding device 200, the sheets might not be sufficiently separated from each other under a certain ambient humidity around the feeding device or a certain condition of sheets P.

In detail, if the ambient humidity of the feeding device is high and sheets are apt to adhere to each other due to moisture contained in the sheets, the top sheet P1 and the next top sheet P2 adhere to each other. If the sheets P adhere to each other, air cannot be injected into a gap between the top sheet P1 and the next top sheet P2 even though air is blown to the front end portions of the sheets, and air is likely to be injected into the gap between the next top sheet P2 and the sheet P positioned below the next top sheet. In this state, the top sheet P1 and the next top sheet P2 are not separated from each other and thus are sucked together onto the suction belt 2 in an overlapping manner.

Further, when the sheets P are in a certain state, that is, in a state in which the front ends of sheets curl down, even though air is blown to the front end portion of the sheets, it is difficult to inject air into the gap between the top sheet P1 and the next top sheet P2. For this reason, air may not be injected into the gap between the top sheet P1 and the next top sheet P2 but, instead, it is likely to be injected into the gap between the next top sheet P2 and the sheet P positioned below the next top sheet. In this state, the top sheet P1 and the next top sheet P2 are not separated from each other and thus are sucked together onto the suction belt 2 in an overlapping manner.

If the suction belt 2 starts to be driven while the top sheet P1 and the next top sheet P2 overlap each other and are sucked together onto the suction belt 2, two sheets are conveyed in an overlapping state. As a result, double feeding occurs.

If double feeding occurs, sheets P are unnecessarily consumed or blank sheets are mixed in printouts so that the quality of a feeding device significantly deteriorates.

In the feeding device according to an aspect of the invention, a suction force of the lower suction unit which is exerted on the top sheet material is smaller than a suction force that is exerted on the top sheet material by the upper surface suction unit. Accordingly, while the upper surface suction unit and the lower suction unit are operating, the top sheet material is sucked onto the conveying member. Here, when the next top sheet material, which becomes a top portion of the plurality of sheet materials after the top sheet material is fed, adheres to the top sheet material and thus both of the top sheet material and the next top sheet material are likely to be sucked together onto the conveying member; the suction force of the lower suction unit is exerted on the next top sheet material positioned below the top sheet material. In this case, since the suction force of the upper surface suction unit is exerted only on the top sheet material and is not likely to be exerted on the next top sheet material positioned below the top sheet material; the next top sheet material positioned below the top sheet material is applied with only the suction force of the lower suction unit. Since the suction force of the lower suction unit is larger than the adhesion between the sheet materials, the next top sheet material overlapping the top sheet material is lifted down by the suction force of the lower suction unit and only the top sheet material is sucked onto the conveying member. Accordingly, it may be possible to more reliably feed only the top sheet material.

SUMMARY OF THE INVENTION

It is an object of the present invention to at least partially solve the problems in the conventional technology.

According to an aspect of the present invention, there is provided a feeding device including: a sheet material housing configured to allow a plurality of sheet materials to be stacked; an upper surface suction unit that sucks a top sheet material which is positioned at the top of sheet materials stacked in the sheet material housing by generating negative pressure at a position facing the upper surface of the top sheet material; a sheet material conveying unit that causes the top sheet material, which is sucked by the upper surface suction unit, to be sucked onto a conveying member and conveys the top sheet material to a subsequent process; and a lower suction unit that exerts a suction force, which is directed downward, on the sheet materials that are stacked in the sheet material housing and positioned near the top sheet material, wherein a suction force which is exerted on the top sheet material by suction of the lower suction unit is smaller than a suction force which is exerted on the top sheet material by suction of the upper surface suction unit and is larger than adhesion between the sheet materials.

According to another aspect of the present invention, there is provided an image forming apparatus including: an image forming section that forms an image on a sheet material that is a recording medium; and a sheet material feeding unit that feeds the sheet material to the image forming section, wherein the feeding device mentioned above is used as the sheet material feeding unit:

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 6A and 6B are views illustrating the connection between a blower and a suction nozzle and floating nozzles, in which FIG. 6A is a view showing the structure including three blowers, and FIG. 6B is a view showing the structure including one blower;

FIGS. 7A and 8B are schematic views showing the structure of a feeding device according to Modification 1, in which FIG. 7A is a side view and FIG. 7B, is a front view;

FIGS. 9A and 9B are schematic views showing the structure of a feeding device according to Modification 2, in which FIG. 9A is a side view and FIG. 9B is a front view;

FIGS. 17A and 17B are views illustrating a case where only floating air is blown in the feeding device in the related art, in which FIG. 17A is a side view and FIG. 17B is a front view;

FIGS. 18A and 18B are views illustrating a case where floating air and separating air are blown in the feeding device in the related art, in which FIG. 18A is a side view and FIG. 18B is a front view;

FIGS. 19A and 19B are views illustrating a case where separation failure occurs in the feeding device in the related art, in which FIG. 19A is a side view and FIG. 19B is a front view;

FIGS. 20A and 20B are views illustrating a case where a sheet blocking member is provided in the feeding device in the related art, in which FIG. 20A is a side view and FIG. 20B is a front view;

FIGS. 21A and 21B are views illustrating a clearance between an end fence and the rear ends of sheets in the related art, in which FIG. 21A is a view illustrating a case where there is no clearance and FIG. 21B is a view illustrating a case where there is a clearance.

DETAILED DESCRIPTION OF THE PREFERRED EMBODIMENTS

A feeding device according to an embodiment of the invention will be described below. First, the entire structure and operation of an image forming apparatus to which the feeding device according to this embodiment may be applied will be described.

Figure 2:
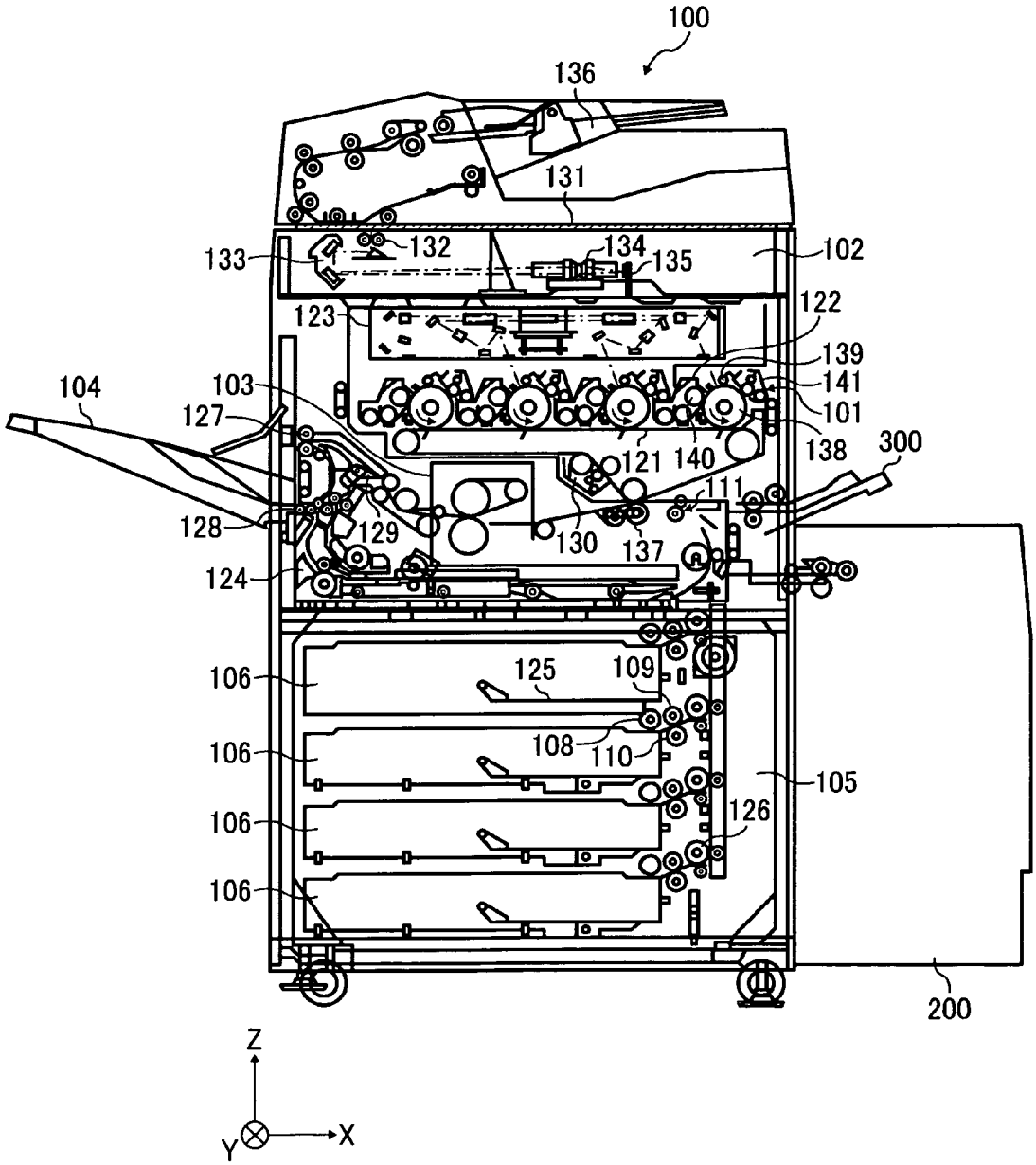
FIG. 2 is a schematic view showing the structure of a copying machine according to one embodiment.

FIG. 2 is a schematic view showing the structure of a copying machine 100 that is an image forming apparatus according to one embodiment.

The copying machine 100 has functions of a so-called digital color copying machine that reads out a document by scanning the document, digitizes the document, and copies the document onto a sheet material.

As shown in FIG. 2, the copying machine 100 includes an image forming section 101, a reading section 102, a fixing section 103, a discharging section 104, and the like. Further, the copying machine 100 further includes a sheet feeding section 105 having multiple stages at the lower portion thereof. A plurality of body sheet-feed trays 106 are provided at the multiple stages of the sheet feeding section 105, respectively. Each body sheet-feed tray 106 may be loaded with sheet-shaped recording media (hereinafter, referred to as sheet materials) such as plain paper, coated paper, and OHP sheet materials. Each body sheet-feed tray 106 is provided with a body-tray bottom plate 125, a pick-up roller 108, a feed roller 109, a reverse roller 110, and a sheet feeding roller 126. The body-tray bottom plate 125 is configured to be movable up and down in a vertical direction according to the amount of stacked sheet materials remaining in the body sheet-feed tray 106. The pick-up roller 108 applies a conveying force to the top sheet material of the stacked sheet materials so as to convey the top sheet material to a pair of rollers that is composed of the feed roller 109 and the reverse roller 110. The feed roller 109 and the reverse roller 110 form a separation unit which conveys only one sheet material (top sheet material) of the sheet materials to the sheet feeding roller 126 when a plurality of sheet materials are conveyed by the pick-up roller 108.

That is, one top sheet material of the stacked sheet materials in the body sheet-feed tray 106 is fed by the rotation of the pick-up roller 108 and the sheet materials are separated one after another by the reverse roller 110.

Further, the separated sheet material is sent from a sheet-feed tray 6 by the rotations of the feed roller 109 and the sheet feeding roller 126, and is conveyed to a pair of registration rollers 111 of the image forming section 101 that is disposed on the downstream side of the sheet-feed tray 6. The sheet material, which is separated and conveyed in this way, bumps against a nip formed by the pair of registration rollers 111, so that the conveyance of the sheet material is temporarily stopped and the sheet material is on standby. Then, the sheet material is sent to a secondary transfer nip for the formation of an image.

The reading section 102 includes a contact glass 131, a CCD camera 135, and a lens 134. The upper surface of the contact glass 131 contacts the surface of a document to be read out. The CCD camera 135 and the lens 134 are used to read out the image of the document as image information. Further, the reading section includes a first traveling body 132 and a second traveling body 133. The first traveling body 132 includes a light source or a reflecting mirror and moves along a read position of a document. The second traveling body 133 moves following the movement of the first traveling body 132 so that the length of an optical path from the reflecting mirror of the first traveling body 132 to the CCD camera 135 may be constant. Furthermore, an automatic document feeding unit 136 is disposed above the reading section 102.

An intermediate transfer belt 121 is disposed substantially in the middle portion of the image forming section 101. Four image forming portions 122, which form toner images of respective colors on photosensitive elements 138 corresponding to the respective colors, are disposed above the intermediate transfer belt 121. A charging unit 139, a developing unit 140, a photosensitive element cleaning unit 141, and the like are disposed around the photosensitive element 138 of each of the image forming portions 122. The charging unit 139 uniformly charges the surface of the photosensitive element 138. The developing unit 140 forms a toner image by developing a latent image that is formed on the surface of the photosensitive element 138. The photosensitive element cleaning unit 141 removes a toner image remaining on the surface of the photosensitive element 138 after the toner image is transferred to the intermediate transfer belt 121. Above the four image forming portions 122, disposed is an exposing unit 123, which irradiates the photosensitive elements of the respective image forming portions 122 with exposure light corresponding to the respective colors.

A secondary transfer roller 137, which forms a secondary transfer nip together with the intermediate transfer belt 121, is disposed below the intermediate transfer belt 121. An intermediate transfer belt cleaning unit 130, which removes residual toner remaining on the surface of the intermediate transfer belt 121 that has passes through the secondary transfer nip, is disposed on the downstream side of the secondary transfer nip in the moving direction of the surface of the intermediate transfer belt 121.

A duplex unit 124 is disposed below the fixing section 103 that is disposed below the intermediate transfer belt 121. The duplex unit 124 conveys a sheet material toward a transfer position so that the rear surface of the sheet material with the front surface, on which an image has been formed by the fixing section 103, becomes an upper surface. A discharging roller 127 is disposed on the left side of the fixing section 103 in FIG. 2. The discharging roller 127 discharges a sheet material with the front surface, on which an image has been formed by the fixing section 103, toward the discharging section 104. A reverse discharging roller 128 is disposed below the discharging roller 127. The reverse discharging roller 128 conveys a sheet material to the discharging section 104 so that the front surface of the sheet material on which an image has been formed faces down. Further, a bifurcating claw 129 is disposed between the fixing section 103 and the discharging roller 127. The bifurcating claw 129 switches the conveying path of a sheet material, which has passed through the fixing section 103, between a conveying path leading to the discharging roller 127 and a conveying path leading to the reverse discharging roller 128 and the duplex unit 124.

Further, the copying machine 100 according to this embodiment includes a feeding device 200 as a sheet feeding means different from the sheet feeding section 105. The copying machine 100 includes a bypass tray 300 (manual paper feed tray) disposed above the feeding device 200. Furthermore, when an image is formed, sheet materials are sequentially separated and fed from the selected body sheet-feed tray 106 of the sheet feeding section 105, the bypass tray 300, or the feeding device 200 one after another.

Next, the feeding device 200 according to this embodiment will be described.

Figure 3:
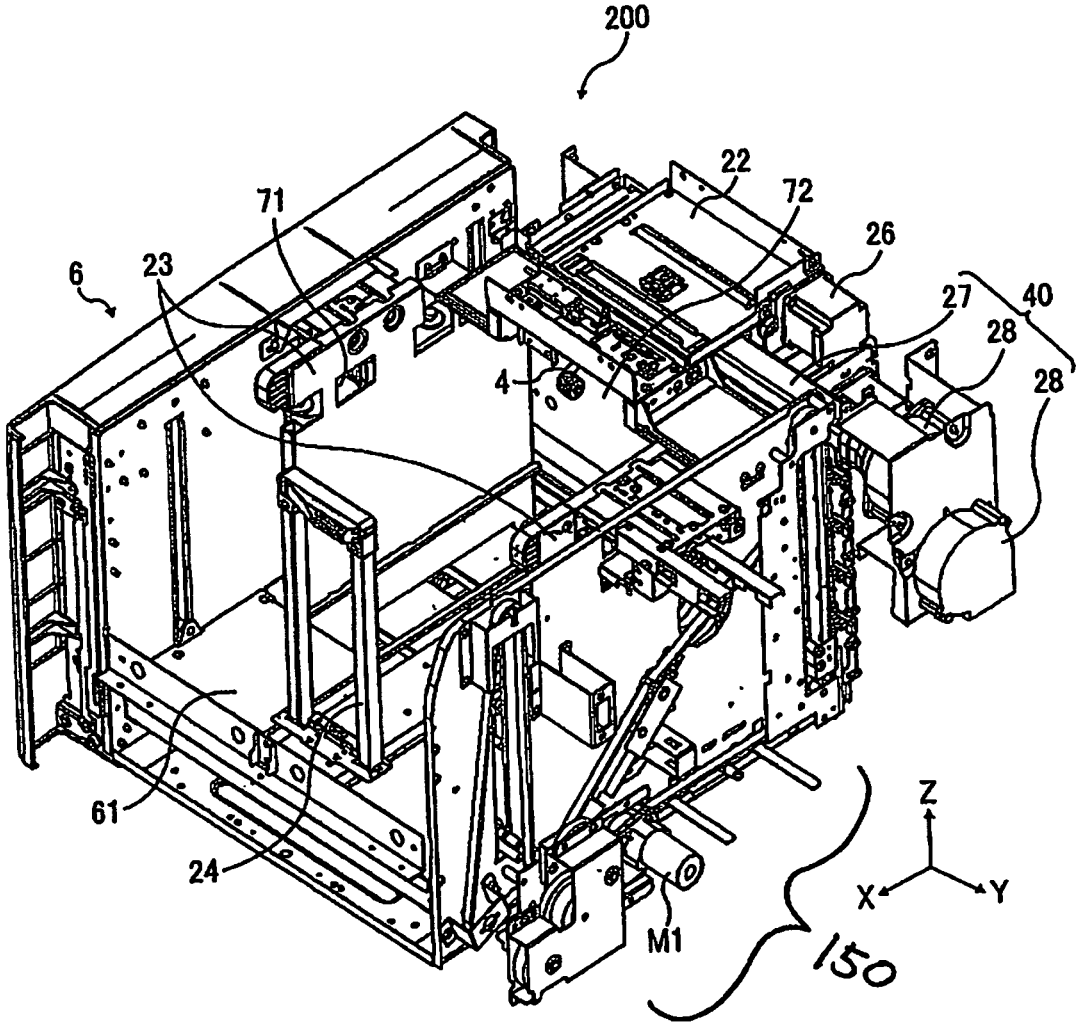
FIG. 3 is a perspective view showing the vicinity of a sheet-feed tray of the feeding device shown in FIG. 1.

FIG. 1 is a schematic view showing the feeding device 200 according to this embodiment, and FIG. 3 is a perspective view showing the vicinity of a sheet-feed tray 6 shown in FIG. 1.

As shown in FIGS. 1 and 3, the feeding device 200 includes a sheet-feed tray 6 that is a sheet material housing having a bottom plate 61 and a sheet feeding unit 22 that is disposed above the sheet-feed tray 6. A bundle of sheets P, sheet materials, is stacked on the bottom plate 61. The sheet feeding unit 22 includes a suction belt 2 and an upper surface suction unit 40. When the upper surface suction unit 40 is driven to operate, the upper surface suction unit 40 generates negative pressure so that the flow of air shown by an arrow B of FIG. 1 is generated. Suction holes, which pass through the suction belt 2 from the front surface of the belt to the rear surface of the belt, are formed to be distributed over the entire area of the suction belt. The upper surface suction unit 40 acts so as to make the sheet P be sucked up onto the lower surface of the suction belt 2 by generating negative pressure on the lower side thereof. The sheet feeding unit 22 serves as a sheet material conveying means. The sheet material conveying means takes the top sheet of the bundle of the sheets P, which are stacked in the sheet-feed tray 6, one after another and feeds the top sheet to the image forming section 101 that corresponds to the following process.

As shown in FIG. 1, the feeding device 200 includes blowing units 1 that blow air to the vicinity of the front end of the top sheet P1 which is positioned at the top of the sheets P stacked in the sheet-feed tray 6 in a sheet feeding direction (a direction of an arrow D in FIG. 1).

Further, side fences 23 are provided at both sides of the sheet-feed tray 6 of the feeding device 200. The side fences 23 guide side surfaces of the bundle of the sheets P, which are stacked on the bottom plate 61, in a width direction (a direction parallel to a Y axis in the drawings). An end fence 24, which presses the rear end surface of the bundle of the sheets, is provided in the sheet-feed tray at the rear side of the bundle of the sheets P in the sheet feeding direction.

Furthermore, in the feeding device 200, the sheets P in a bundle are arranged in the sheet-feed tray 6 so as to fit the sheet size defined by the sheet-feed tray 6 in a manner such that the front ends of the sheets P are aligned with each other. For this purpose, the feeding device 200 includes a front fence 72 that aligns the front ends of the sheets P in a bundle. In addition, a sheet blocking member 7 is disposed at an upper end portion of the front fence 72 of the sheet-feed tray 6.

Side air discharge ports 71 are formed in the side fences 23. The side air discharge ports 71 are air discharge ports through which air from the blowing units 1 can be blown to the vicinity of side end portions of the bundle of the sheets P in order to regulate the sheets P and to cause the sheets P to float. Further, in the feeding device 200, both of the two side fences 23 are moved toward the center in the width direction to fit the sheet size.

The feeding device 200 is provided with a sheet upper surface sensor 3, which is a means configured to detect the height of stacked sheets, on the upstream side of, the suction belt 2 in the sheet feeding direction. The sheet upper surface sensor 3 includes an actuator 4 that can swivel about a pivot 42 in a direction of an arrow E of FIG. 1, and a photosensor 5 that detects the position of the actuator 4. The actuator 4 oscillates according to a decrease in number of the sheets P stacked in the sheet-feed tray 6; and the photosensor 5 detects the change of the position of the actuator caused by the oscillation of the actuator, so that the sheet upper surface sensor 3 detects the height of the upper surface of the top sheet P1.

Figure 11:
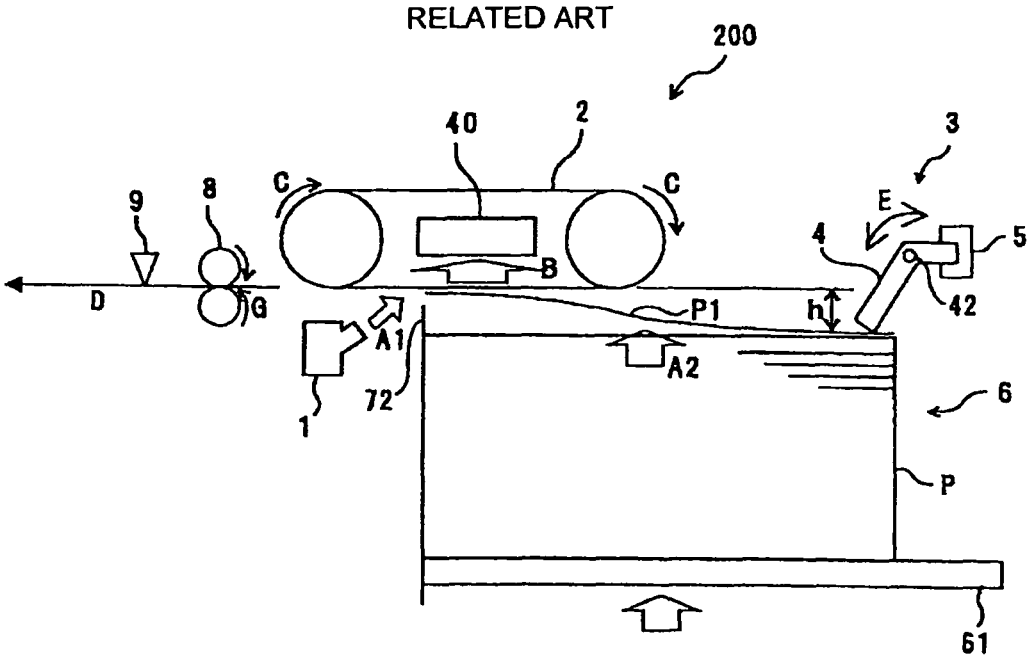
FIG.11 RELATED ART
FIG. 11 is a view illustrating an example of a feeding device in the related art that separates and feeds a sheet material by making the sheet material be sucked onto a conveying member.
Figure 12:
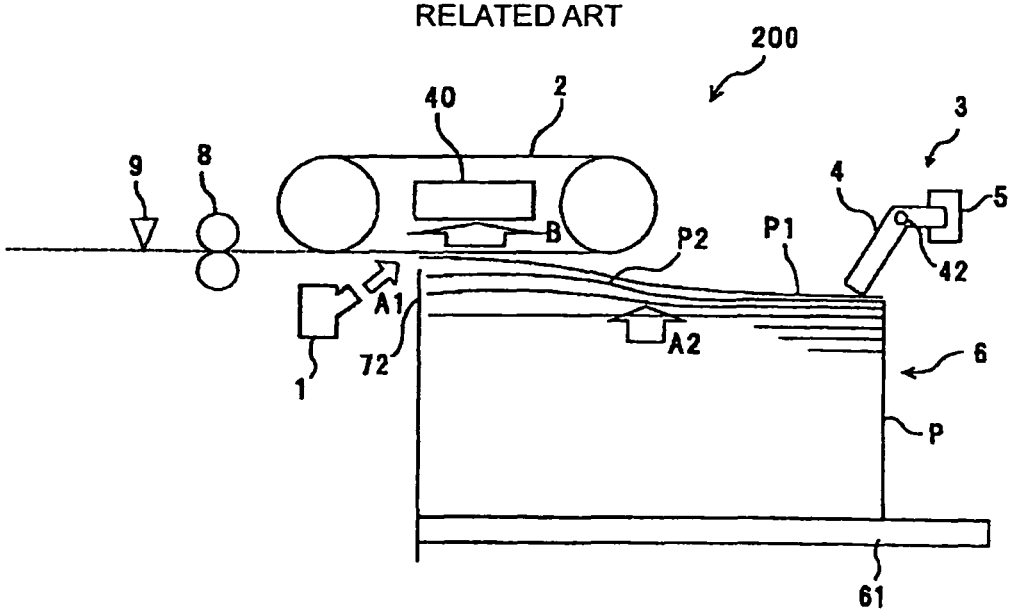
FIG.12 RELATED ART
FIG. 12 is a view illustrating a state where blowing units start to blow air and an upper surface suction unit starts to suck air in the feeding device shown in FIG. 11.
Figure 13:
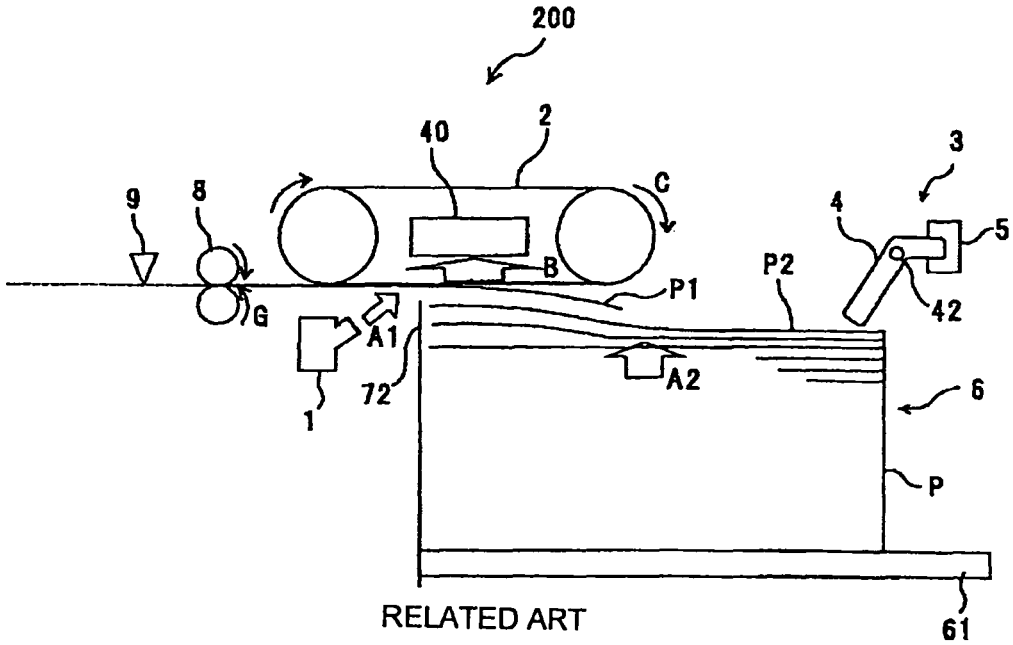
FIG. 13 is a view illustrating a state where a suction belt and a pair of conveying rollers start to be driven in the state of FIG. 12.
Figure 14:
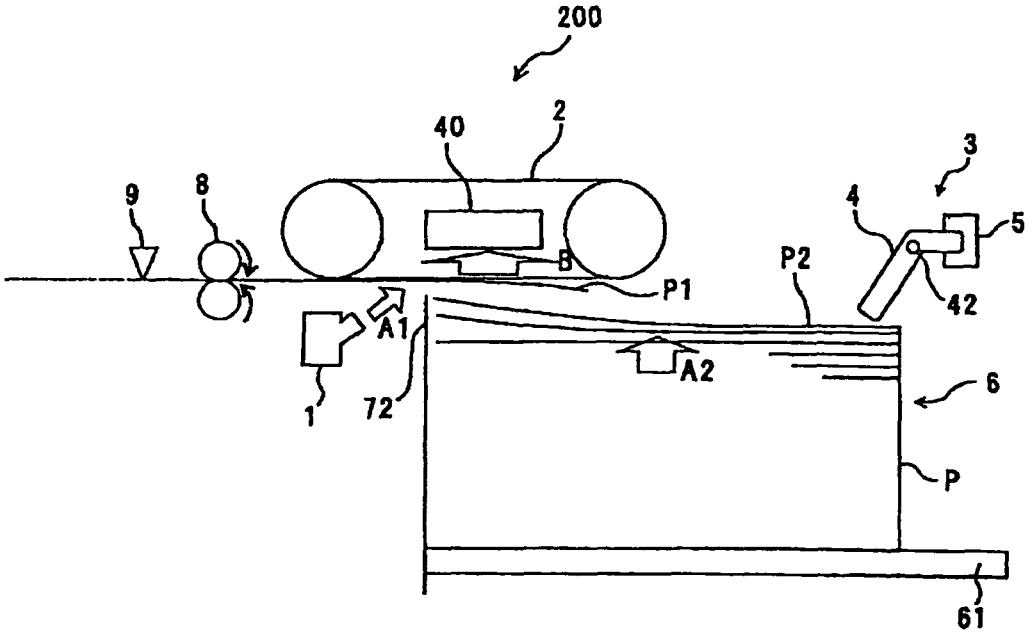
RELATED ART FIG.14
FIG. 14 is a view illustrating a state where the drive of the suction belt is stopped in the state of FIG. 13.
Figure 15:
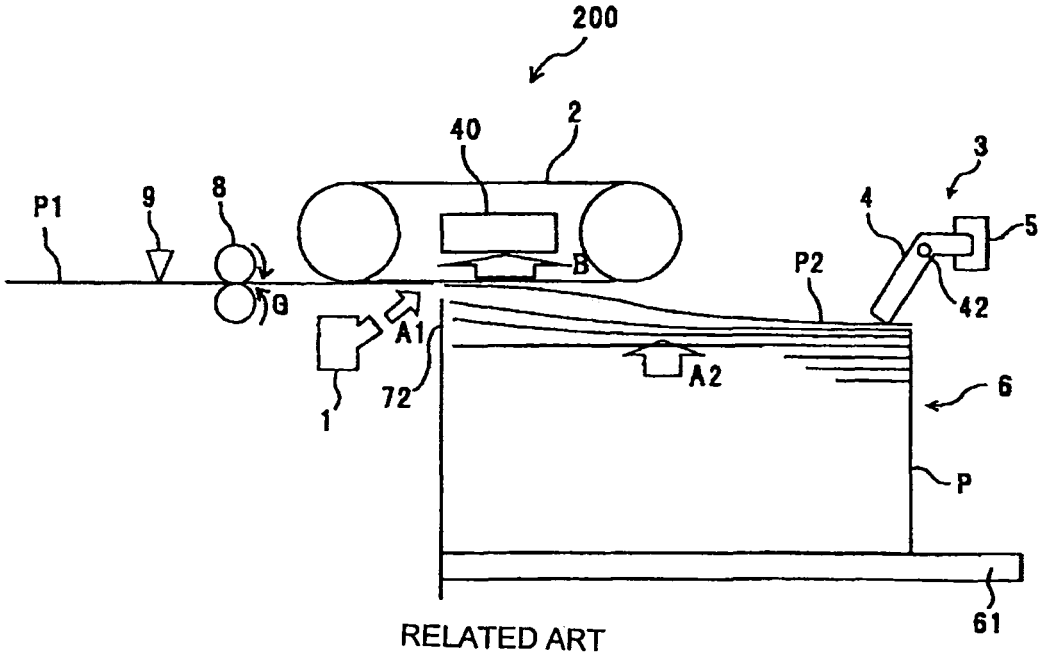
FIG. 15 is a view illustrating a state where a rear end of a sheet has passed through a suction area in the state of FIG. 14.

In the feeding device 200, a distance h (shown in FIG. 11) between the lower surface of the suction belt 2 and the upper surface of the top sheet P1 of the sheets P, which are stacked in the sheet-feed tray 6 and which decrease in number by the feeding of sheets, needs to be kept in a constant range. For this purpose, the height of the upper surface of the top sheet P1 is detected by the sheet upper surface sensor 3; and the driving of a bottom plate lifting motor M1, which is a driving source of a lifting mechanism 150 for moving the bottom plate 61 of the sheet-feed tray 6 up and down, is controlled on the basis of the detection signal of the sheet upper surface sensor 3. Accordingly, it may be possible to adjust the height of the bottom plate 61, and to control the distance h between the lower surface of the suction belt 2 and the upper surface of the top sheet P1 of the sheets P stacked on the bottom plate 61, so that the distance h is kept in a constant range. In the feeding device 200, the sheet upper surface sensor 3 is mounted on a frame of the sheet feeding unit 22.

The upper surface suction unit 40 includes a suction duct 27, a suction blower 28, and a suction chamber (not shown) disposed inside the suction belt 2. The suction chamber is connected to the suction blower 28 through the suction duct 27. When the suction blower 28 is driven, suction is performed from the suction holes of the suction belt 2 that correspond to the positions facing openings of the suction chamber disposed inside the suction belt 2. Further, the width (the length in a Y direction in the drawing) of the opening of the suction chamber is substantially equal to that of the suction belt 2, and a suction force is exerted on over the entire area of the suction belt 2 in the width direction.

Figure 4:
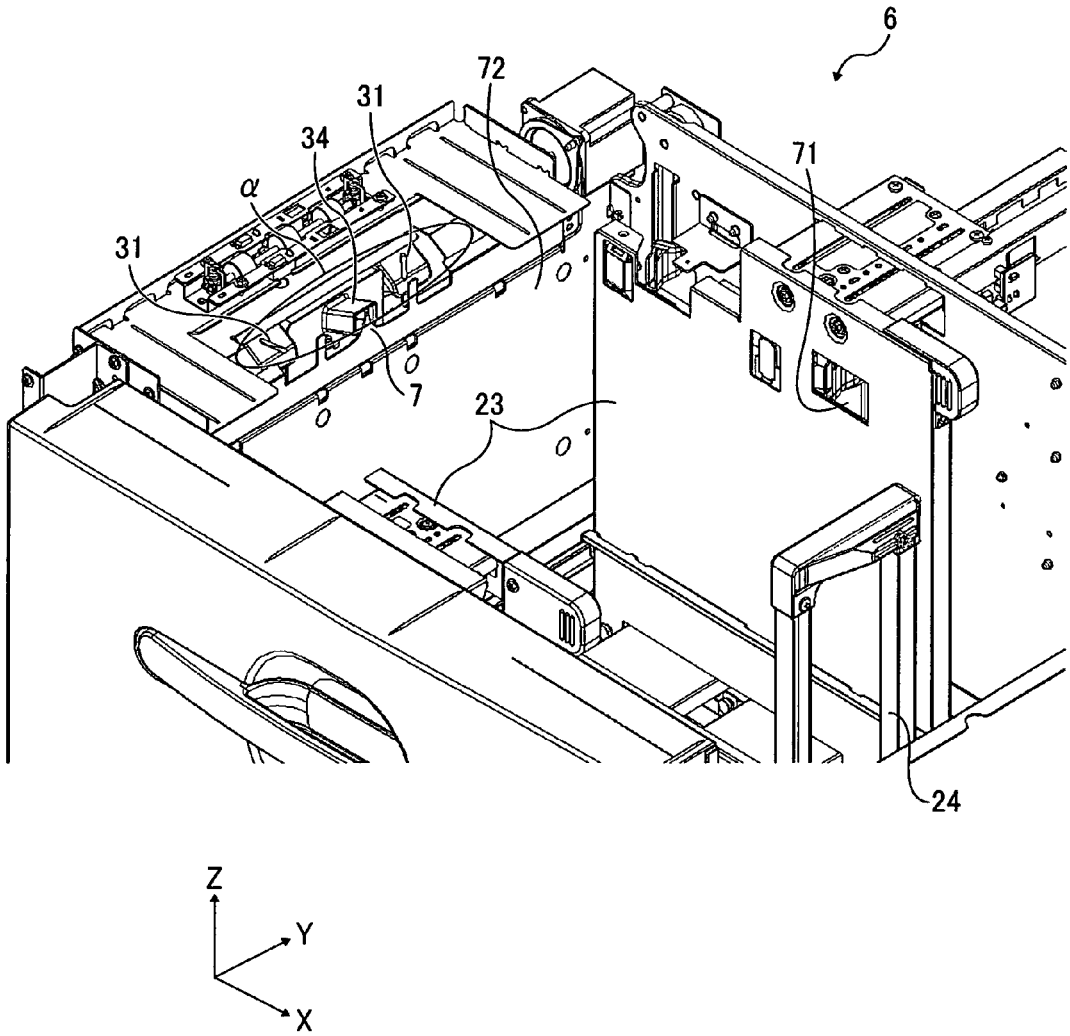
FIG. 4 is a perspective view showing the vicinity of the sheet-feed tray when a sheet feeding unit is removed from the state shown in FIG. 3.
Figure 5:
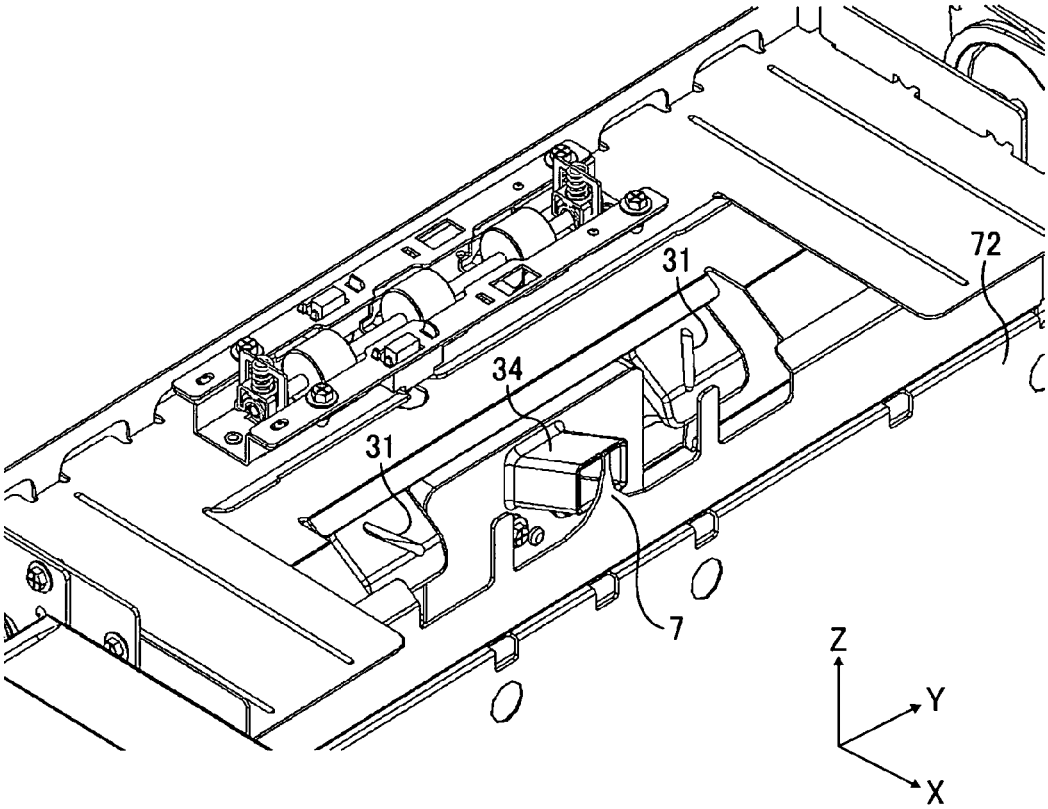
FIG. 5 is an enlarged perspective view showing the vicinity of a suction nozzle of the sheet-feed tray shown in FIG. 4.

FIG. 4 is a perspective view showing the vicinity of the sheet-feed tray 6 when the sheet feeding unit 22 is removed from the state shown in FIG. 3; and FIG. 5 is an enlarged view of an area a of FIG. 4.

As shown in FIGS. 4 and 5, two floating nozzles 31, which are air discharge ports, are disposed to make the sheets P float and to regulate the sheets P; and the blowing units 1 blow air to the vicinity of the front end portion of the bundle of the sheets P near the sheet blocking member 7 that is disposed directly below the sheet feeding unit 22. Moreover, a suction nozzle 34 to be described in detail below is disposed at a middle position between the two floating nozzles 31 near the sheet blocking member 7.

The feeding device 200 blows air toward the front end surfaces and side end surfaces of the plurality of sheets P, which are stacked in the sheet-feed tray 6, from the blowing units 1 such as blowers. Air is injected into a gap between the sheets P by the blowing of air and makes the top sheet P1 float up to the height of the suction belt 2; and the top sheet P1 is sucked onto the suction belt 2 due to the negative pressure generated by the upper surface suction unit 40.

If a belt driving motor 26 is driven and the suction belt 2 endlessly moves in a clockwise direction in FIG. 1 while the top sheet P1 is sucked onto the suction belt 2, the top sheet P1 is conveyed to the image forming section 101 by the movement of the suction belt 2 and thus formation of an image is performed.

The blowing units 1 not only make the top sheet P1 float up to a predetermined height by injecting air into a gap between the sheets P but also regulate the sheet by blowing air to an area at the predetermined height in a height direction.

The sheet blocking member 7, which is disposed at the front end portion of the front fence 72, blocks the front end portion of the bundle of the sheets P and prevents sheets except for the top sheet P1 from being conveyed.

Further, there is provided the sheet upper surface sensor 3 that detects the height of the upper surface of the top sheet P1 by coming into contact with the top surface of the bundle of the sheets P so that the distance h between the suction belt 2 and the position of the top surface of the bundle of the sheets P, which decrease in number by the feeding of the sheets P, always becomes constant. The sheet upper surface sensor 3 includes the actuator 4 and the photosensor 5 that detects the position of the actuator 4. In the feeding device 200, the actuator 4 oscillates according to the decrease in number of the sheets P; and the photosensor 5 detects the change of the position of the actuator caused by the oscillation of the actuator. The driving of the bottom plate lifting motor M1 is controlled on the basis of the detection signal of the photosensor 5, so that the bottom plate 61 is lifted up by a lifting mechanism 150. Accordingly, the distance h between the lower surface of the suction belt 2 and the upper surface of the top sheet P1 of the sheets P, which are stacked on the bottom plate 61, is controlled so as to be kept in a constant range.

A pair of conveying rollers 8 is disposed on the downstream side of the suction belt 2 of the feeding device 200 in the sheet feeding direction, and further conveys a sheet P, which has been conveyed by the suction belt 2 and reached the two conveying rollers, to the downstream side. The conveying force of the pair of conveying rollers 8 is set to be larger than that of the suction belt 2. Moreover, a sheet feed sensor 9, which detects the passing of the sheet P, is provided on the downstream side of the pair of conveying rollers 8 in the sheet feeding direction.

In addition, the feeding device 200 according to this embodiment includes a lower suction unit 18 as a lower suction means. The lower suction unit 18 exerts a suction force, which is directed downward, from the suction nozzle 34 as shown by an arrow J of FIG. 1, on the sheets P that are stacked in the sheet-feed tray 6 and positioned near the top sheet P1. A suction force, which is exerted on the top sheet P1 by the suction of the lower suction unit 18, is smaller than a suction force that is exerted on the top sheet P1 by the suction of the upper surface suction unit 40, and is larger than the adhesion between the sheets P.

Next, a sheet feeding operation of the feeding device 200 shown in FIG. 1 will be described.

When a command to start feeding of a sheet is issued from a control unit of the body of the copying machine 100, the blowing units 1 start to blow air and the upper surface suction unit 40 and the lower suction unit 18 start to suck air while driving of the suction belt 2 is stopped. When the blowing units 1 start to blow air, air is blown to some portions of the front end of each sheet P except for the middle portion of the front end of each sheet P. Accordingly, the both side end portions (in the width direction) of the top sheet P1 of the stacked sheets P come to float. When the upper surface suction unit 40 starts to suck air, negative pressure is generated below the upper surface suction unit 40. In this case, a suction force, which is exerted on the top sheet P1 by the suction of the upper surface suction unit 40, is larger than a suction force that is exerted on the top sheet P1 by the suction of the lower suction unit 18. Accordingly, since the top sheet P1 is sucked onto the upper surface suction unit 40 even at the middle portions of the front ends of the sheets P on which the suction force of the lower suction unit 18 is exerted, the top sheet P1 floats. The floating top sheet P1 is sucked onto the suction belt 2.

When a predetermined time (for example, three seconds) has passed after the blowing units 1 start to blow air and the upper surface suction unit 40 and the lower suction unit 18 start to suck air, the suction belt 2 and the pair of conveying rollers 8 start to be driven while the blowing units 1, the upper surface suction unit 40, and the lower suction unit 18 are operating. The suction belt 2 is driven and the surface of the suction belt 2 is moved in the clockwise direction in FIG. 1 (a direction of an arrow C), so that the top sheet P1, sucked onto the lower surface of the suction belt 2, is conveyed to the downstream side in the sheet feeding direction and reaches the pair of conveying rollers 8. The pair of conveying rollers 8 is rotated in the directions of arrows G in FIG. 1, so that the top sheet is further conveyed to the downstream side.

When the front end of the top sheet P1, which is conveyed by the suction belt 2 and the pair of conveying rollers 8, is detected by the sheet feed sensor 9, the driving of the suction belt 2 is stopped.

The control of stopping the driving of the suction belt 2 as described above is performed due to the following reasons: that is, if the suction belt 2 continues to be driven, the next top sheet P2, which is a sheet P positioned below the top sheet P1, is also attracted toward the suction belt 2 when the top sheet P1 is conveyed and starts to get out of the suction area that is formed by the upper surface suction unit 40. In this case, if the suction belt 2 is still being driven, there is a concern that the continuous feeding occurs, that is, the next top sheet P2 is conveyed together with the top sheet P1. For this reason, when the front end of the top sheet P1 is detected by the sheet feed sensor 9, the driving of the suction belt 2 is stopped. At this time, the top sheet P1 interposes between two rollers, that is, the pair of conveying rollers 8. Further, since the pair of conveying rollers 8 continues to be driven even after the driving of the suction belt 2 is stopped, the top sheet P1 continues to be conveyed. In this case, if the conveying force of the pair of conveying rollers 8 is smaller than that of the suction belt 2, the moving of the top sheet P1 is stopped in a state in which it is sucked onto the suction belt 2, resulting that the conveyance of the top sheet P1 may be stopped. For this reason, the conveying force of the pair of conveying rollers 8 is set to be larger than the conveying force of the suction belt 2 as described above.

Since the pair of conveying rollers 8 is driven even after the driving of the suction belt 2 is stopped, the top sheet P1 continues to be conveyed.

While the top sheet P1 is sucked onto the suction belt 2, side end portions of the front end of the next top sheet P2, in the width direction, are flapped below the top sheet P1 by the air blown from the blowing units 1. Accordingly, the front end of the next top sheet P2 is separated from the sheet P that is positioned below the next top sheet.

Subsequently, immediately after the rear end portion of the top sheet P1 passes through the suction area formed by the upper surface suction unit 40, the next top sheet P2 is floated by the flow of air, which is formed between the upper surface suction unit 40 and the blowing units 1, and is sucked upward onto the suction belt 2.

Then, after a predetermined time passes from the time when the sheet feed sensor 9 detects the front end of the top sheet P1, the suction belt 2 starts to be driven again according to a set sheet feeding interval. Accordingly, like the top sheet P1, the next top sheet P2 is conveyed to the downstream side in the sheet feeding direction by the suction belt 2, reaches the pair of conveying rollers 8, and is further conveyed to the downstream side by the pair of conveying rollers 8.

After that, when the sheet feed sensor 9 detects the front end of the sheet P while the blowing units 1, the upper surface suction unit 40, the lower suction unit 18, and the pair of conveying rollers 8 are operating, the driving operation of the suction belt 2 is turned off. Further, after a predetermined time passes from the time when the sheet feed sensor 9 detects the front end of the sheet P, the driving operation of the suction belt 2 is turned on. In this way, if the on/off control of the driving operation of the suction belt 2 is repeated while the blowing units 1, the upper surface suction unit 40, the lower suction unit 18, and the pair of conveying rollers 8 are operating, the sheets P stacked in the sheet-feed tray 6 are sequentially fed into the copying machine 100 one after another.

Like the feeding device 200, a feeding device, in which the sheet P is made to be sucked onto the suction belt 2 by using negative pressure, can feed a sheet at a high speed as compared with a friction separation type feeding device. The reason for this is as follows. That is, since it takes a predetermined time to separate a sheet from a bundle of sheets by friction in the friction separation type feeding device, there is a limit in coping with high linear speed of a sheet and high productivity. Meanwhile, immediately after the top sheet P1, which is a previous sheet material sucked onto the suction belt 2, passes through the suction area in the feeding device 200, the next top sheet P2 as a next sheet material is separated from a potential next top sheet P and sucked onto the suction belt 2 by the suction operation. Accordingly, since the sheet P separated by the flow of air is conveyed merely by the means of the suction belt 2, it may be possible to cope with high linear speed of a sheet and high productivity.

The feeding device 200 according to this embodiment is different from the feeding device 200 in the related art described with reference to FIGS. 11 to 15 in that the feeding device 200 according to this embodiment includes the lower suction unit 18. The lower suction unit 18 exerts a suction force, which is directed downward, on the middle portion of a sheet P in the width direction of the sheet.

Here, regarding the feeding device 200 in the related art described with reference to FIGS. 11 to 15, the movement of the front end of a sheet P at the time when air is blown to the front end of the sheet P by the blowing units 1 will be described.

Figure 16:
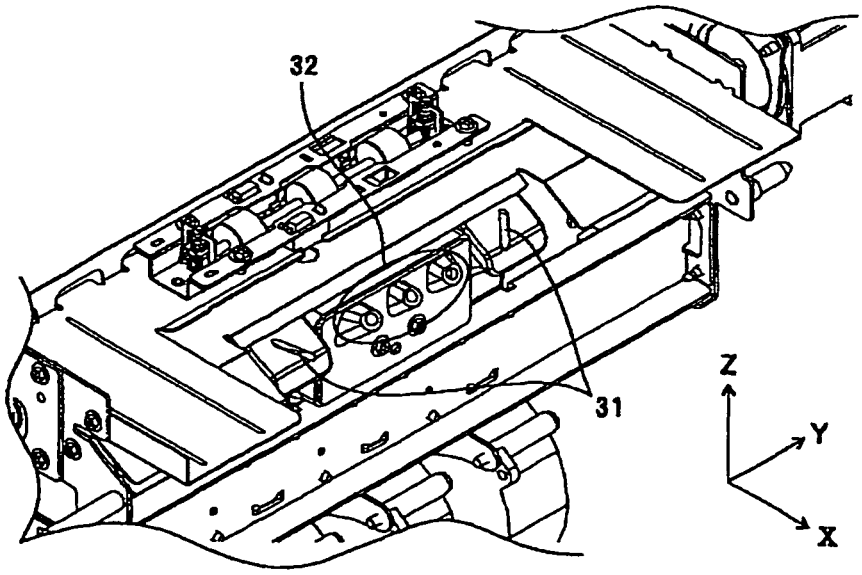
RELATED ART FIG.16
FIG. 16 is an enlarged perspective view showing the vicinity of floating nozzles and separating nozzles of a feeding device in the related art.

FIG. 16 is a perspective view showing the vicinity of discharge ports 31 and 32 through which the blowing units 1 blow air to the front end of a sheet P. In the structure shown in FIG. 16, the discharge port through which the blowing units 1 blow air to the front end of a sheet P is divided into the floating nozzle 31 and the separating nozzle 32 in which the functions of the nozzles are different from each other.

Figure 17A:
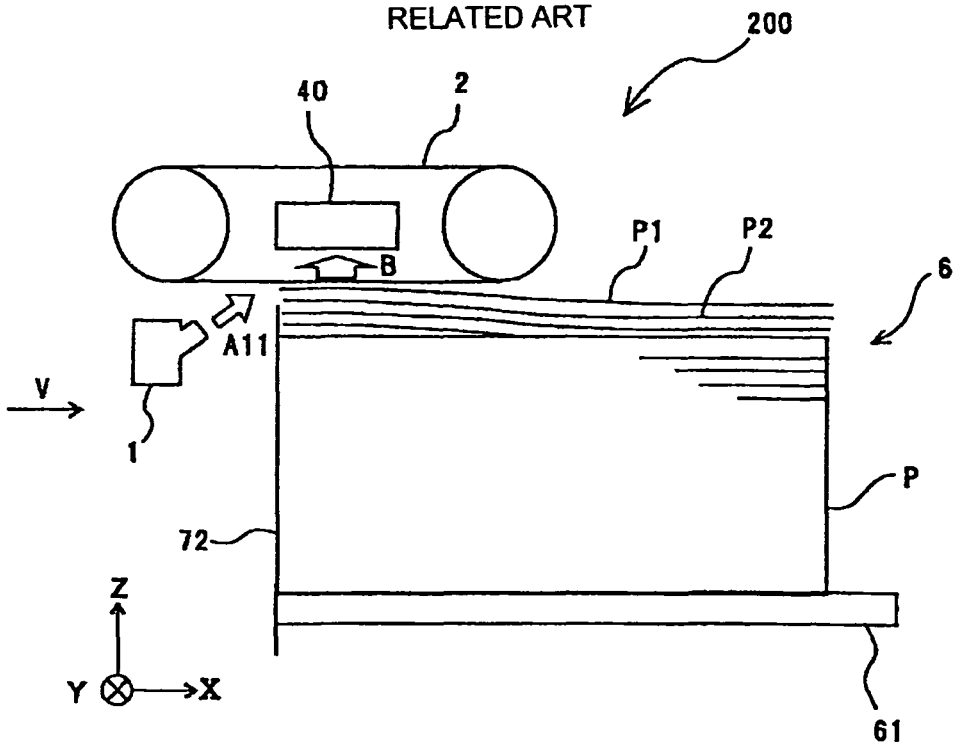
FIG.17A RELATED ART
Figure 17B:
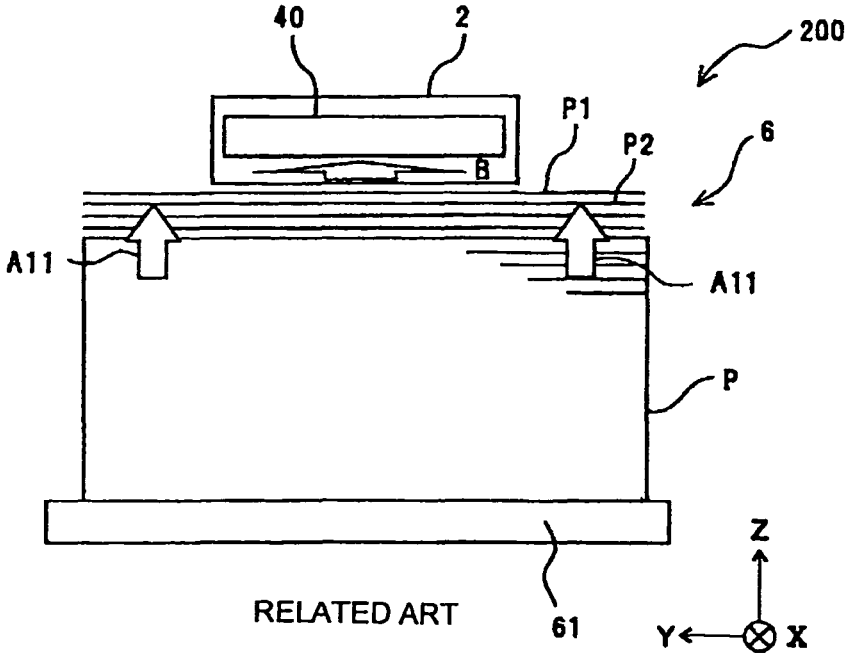

FIGS. 17A and 17B are views illustrating a case in which air is blown from only the floating nozzle 31. FIG. 17A is a side view of the feeding device 200 when the feeding device 200 is seen in the same direction as the directions of FIGS. 11 to 15; and FIG. 17B is a front view of the feeding device 200 when the feeding device is seen in a direction of an arrow V of FIG. 17A.

If air is blown from only the floating nozzle 31 as shown by an arrow A11 of FIG. 17, as air is blown to the vicinity of the top sheet P1 at the front end portions of the sheets P, the sheets P positioned near the top sheet P1 float and the sheets P are separated from each other at the same time. The top sheet P1 of the floating sheets P is sucked onto the suction belt 2 and gets ready to be conveyed.

Figure 18A:
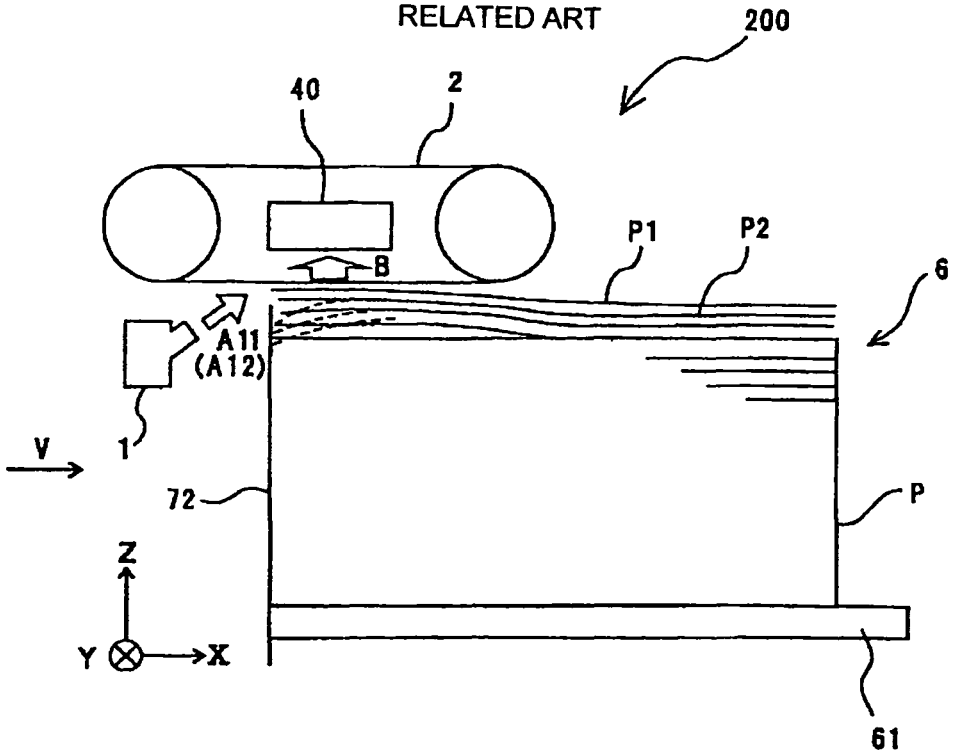
FIG.18A RELATED ART
Figure 18B:
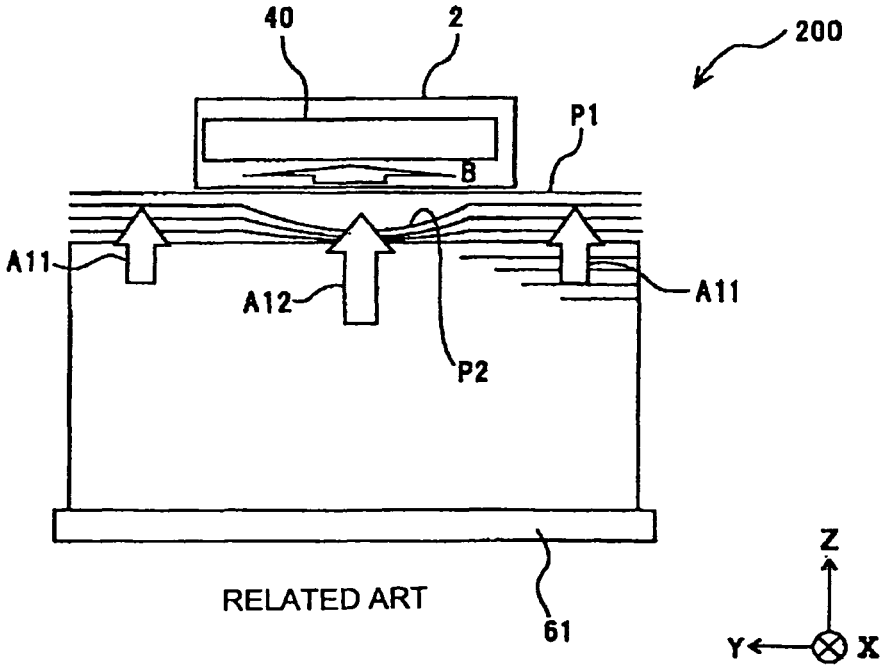

Next, FIGS. 18A and 18B show a state where air is also blown from the separating nozzles 32 in the state of FIG. 17. FIGS. 18A and 18B are views illustrating a case in which air is blown from both of the floating nozzles 31 and the separating nozzles 32. FIG. 18A is a side view of the feeding device 200, and FIG. 18B is a front view of the feeding device 200 when the feeding device is seen in a direction of an arrow V of FIG. 18A.

Due to the shapes of the nozzles shown in FIG. 16, among air components in respective discharge directions of the air blown obliquely upward from the floating nozzles 31, an upright direction component is larger than a lateral direction component in terms of a current of air. Meanwhile, in connection with the air blown obliquely upward from the separating nozzle 32, a lateral direction component is larger than the upright direction component. That is, the air, which is blown from the separating nozzle 32, is an air current in which a horizontal current component is large and which has a certain thickness in a vertical direction. For this reason, the air, which is blown to the middle portion of the sheet P from the separating nozzle 32 as shown by an arrow A12 of FIGS. 18A and 18B, bumps against the lower surface of the top sheet P1 sucked upward onto the suction belt 2, and is changed into a flow that is directed downward. Further, the next top sheet P2 and other sheets P positioned below the next top sheet P2, other than the top sheet P1, are pushed down by the flow of air that is directed downward. Accordingly, the middle portions of the next top sheet P2 and other sheets P which are positioned below the next top sheet P2 sag down to be lower than the end portions thereof in the width direction, as shown by a broken line of FIG. 18A or as shown in FIG. 18B.

Since the middle portions of the next top sheet P2 and other sheets P which are positioned below the next top sheet P2, are pushed down as described above, the top sheet P1 is separated from the next top sheet P2 and other sheets P which are positioned below the next top sheet P2. As a result, only the top sheet P1, which is sucked upward onto the suction belt 2, is conveyed.

Various feeding devices are required to be able to feed sheets of a wide diversity of types, for example, from a thin sheet to a thick sheet. In a feeding mechanism, which uses the blowing of air to separate a sheet, like the feeding device 200 in the related art, sheets P float when air is blown to the sheets P that are set in the sheet-feed tray 6, from the floating nozzle 31.

Here, like in the feeding device 200 shown in FIGS. 16 to 18, when air (hereinafter, referred to as floating air) is blown from the floating nozzle 31 and air (hereinafter, referred to as separating air) is blown from the separating nozzle 32, the top sheet P1 is separated from the next top sheet P2 at the middle portion of the sheet by the separating air (an arrow A12 of FIGS. 18A and 18B). However, the top sheet may be insufficiently separated from the next top sheet under a certain ambient humidity around the feeding device 200 or a certain condition of sheets stacked in the sheet-feed tray 6.

In detail, if the ambient humidity around the feeding device 200 is high, the sheets P stacked in the sheet-feed tray 6 contain a large amount of moisture. For this reason, the sheets P are apt to adhere to each other, so that it is difficult to separate the sheets. As a result, separation failure may occur. Further, if the front ends of the sheets P stacked in the sheet-feed tray 6 are curled down, it is difficult to inject the separating air to a gap between the top sheet P1 and the next top sheet P2. If the separating air is not injected into the gap between the top sheet P1 and the next top sheet P2, separation failure may occur.

Figure 19A:
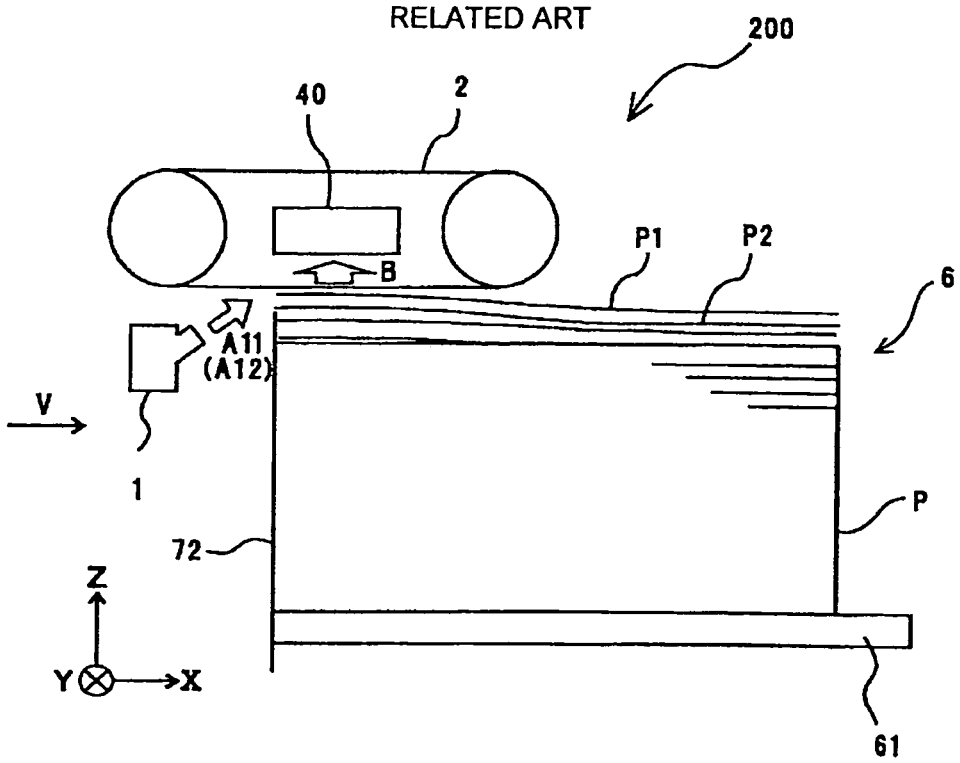
FIG.19A RELATED ART
Figure 19B:
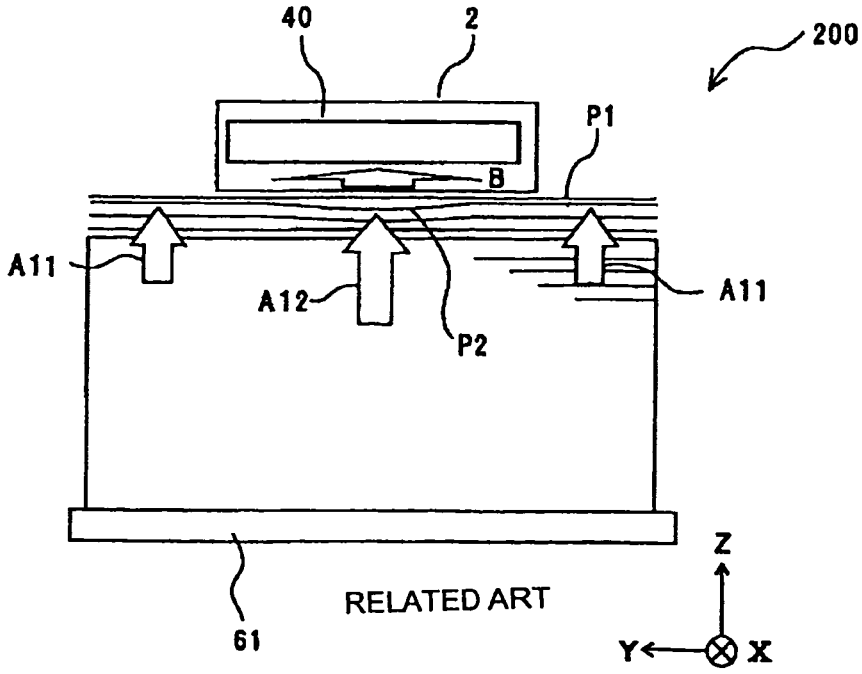

FIGS. 19A and 19B are views showing the feeding device 200 in the related art when sheets P are insufficiently separated from each other. FIG. 19A is a side view of the feeding device 200, and FIG. 19B is a front view of the feeding device 200 when the feeding device is seen in a direction of an arrow V of FIG. 19A.

If sheets are fed in a state in which the sheets P are insufficiently separated from each other as shown in FIGS. 19A and 19B, the next top sheet P2 is pressed against the top sheet P1 from below by the blowing of the floating air and the separating air, so that the top sheet may not be separated from the next top sheet. Accordingly, two sheets are likely to be conveyed while overlapping each other, resulting in double feeding.

As the structure for preventing the double feeding in which the sheets P other than the top sheet P1 are dragged by the top sheet P1 and fed together with the top sheet P1 as described above, there is a structure where a sheet blocking member is disposed at the front end of a sheet-feed tray as in a feeding device disclosed in Japanese Patent Application Laid-open No. 07-101575.

Figure 20A:
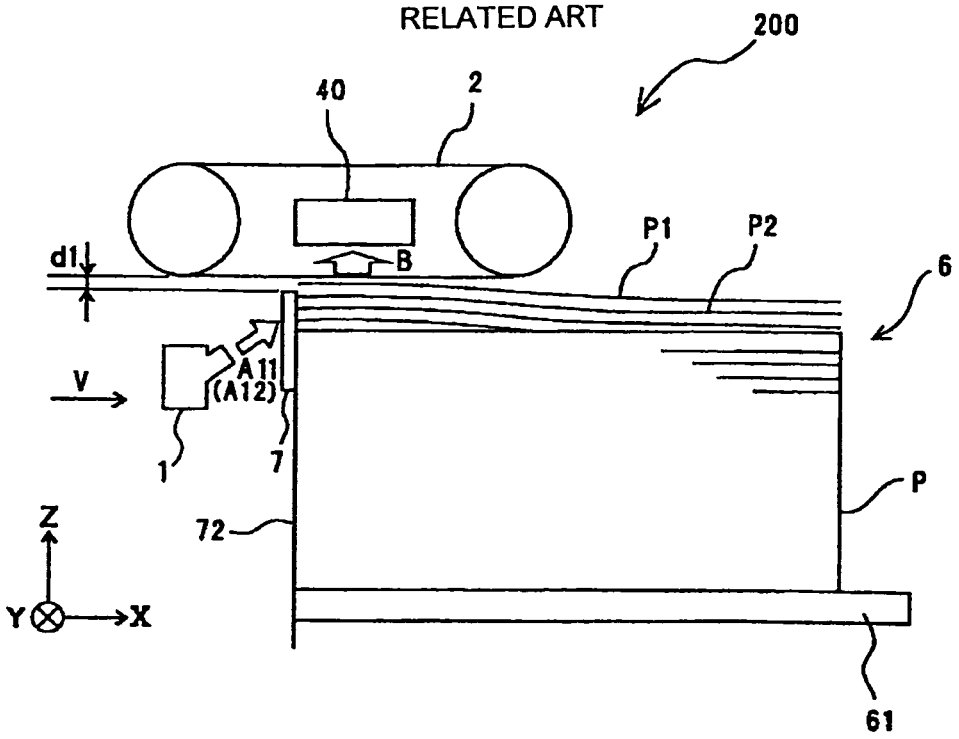
FIG.20A RELATED ART
Figure 20B:
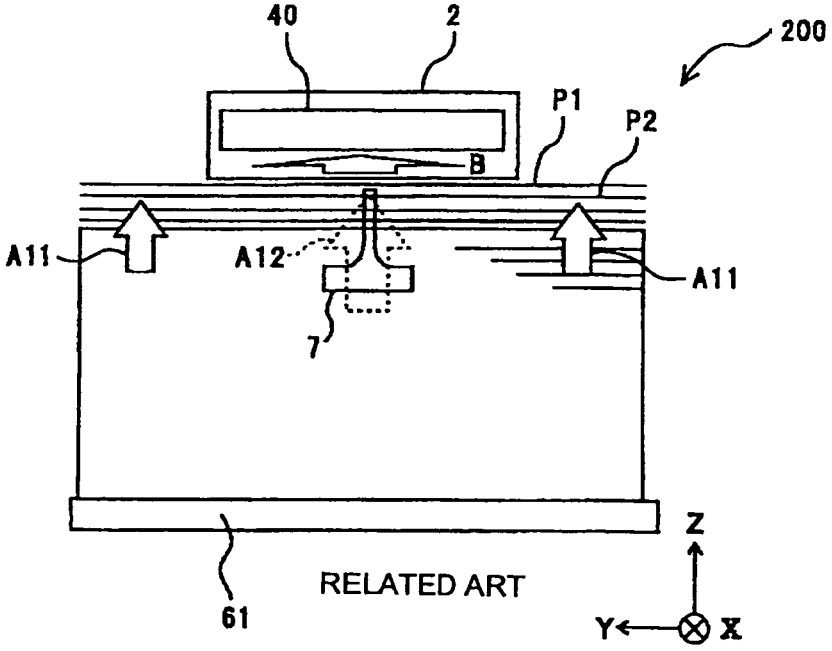

FIGS. 20A and 20B are views showing the feeding device 200 where the sheet blocking member 7 is disposed on the front fence 72 which is provided in the front end of the sheet-feed tray 6. FIG. 20A is a side view of the feeding device 200 and FIG. 20B is a front view of the feeding device 200 when the feeding device is seen in a direction of an arrow V of FIG. 20A.

The sheet blocking member 7 is disposed directly below the suction belt 2 as shown in FIGS. 20A and 20B. Accordingly, in order to prevent the breakage of the suction belt 2, a clearance d1 between the suction belt 2 and the sheet blocking member 7 needs to be in the range of 1 to 3 mm. For this reason, if the middle portion of the next top sheet P2 is insufficiently pushed down by the separating air, the front end of the next top sheet P2 is not caught by the sheet blocking member 7. As a result, an effect of blocking a sheet is not obtained.

Further, an appropriate clearance needs to be kept between the end fence 24 and the rear end of the bundle of the sheets P stacked in the sheet-feed tray 6.

Figure 21A:
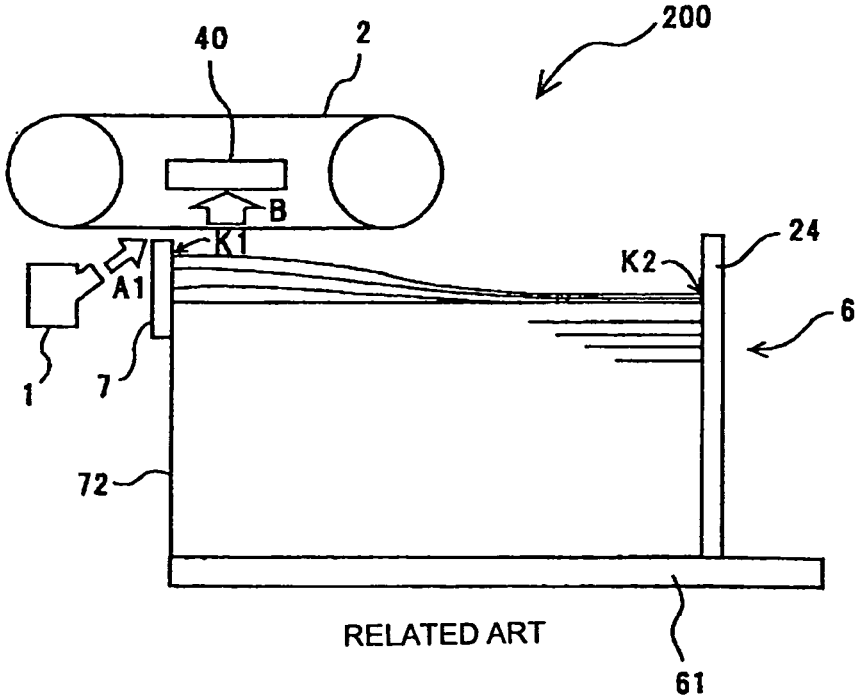
Figure 21B:
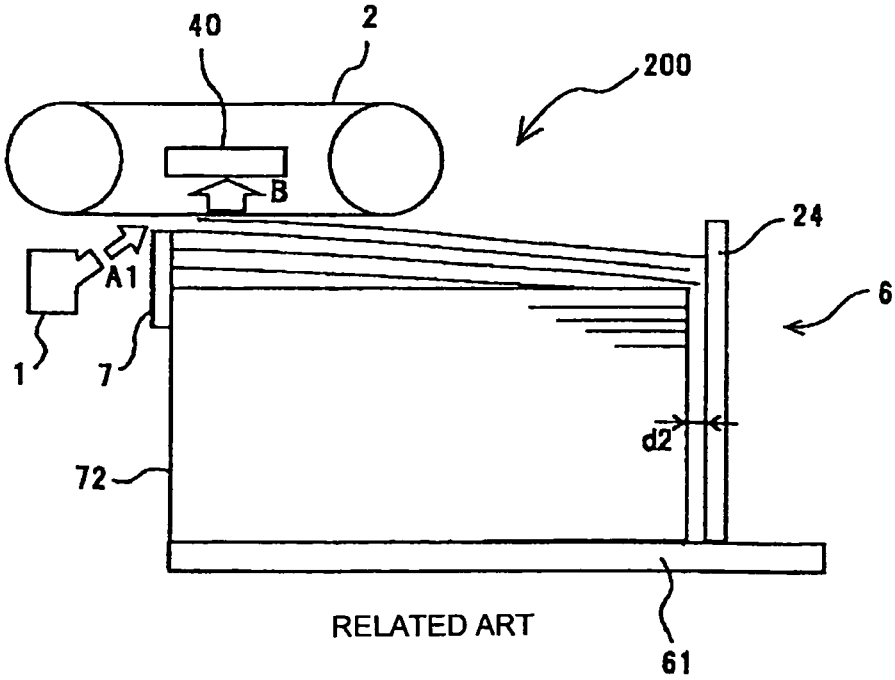
RELATED ART FIG.21B

FIGS. 21A and 21B are views illustrating a clearance between the end fence 24 and the rear ends of sheets P stacked in the sheet-feed tray 6. FIG. 21A is a view illustrating a state where there is no clearance between the end fence 24 and the rear ends of sheets P, and FIG. 21B is a view illustrating a state where there is an appropriate clearance d2 between the end fence 24 and the rear ends of sheets P.

If there is no clearance between the end fence 24 and the rear ends of sheets P as shown in FIG. 21A, the sheets P come into contact with both of the end fence 24 and the sheet blocking member 7 (arrows K1 and K2 of FIG. 21A) and thus are braced and tightly held between the end fence 24 and the sheet blocking member 7, which obstructs floating of the sheets. Meanwhile, if there is an appropriate clearance d2 between the end fence 24 and the rear ends of the sheets P as shown in FIG. 21B, the sheets come into contact with only one of the end fence 24 and the sheet blocking member 7. For this reason, it may be possible to prevent the obstruction of the floating of the sheets that is attributable to the state in which the sheets are braced and tightly held between the end fence 24 and the sheet blocking member 7.

If there is an appropriate clearance d2 between the end fence 24 and the rear ends of the sheets P so that the floating of the sheets P is not obstructed, the top sheet P1 floats while it is moving in a direction opposite to the sheet feeding direction when air is blown to the bundle of the sheets P to make the top sheet P1 float. Further, the rear end of the top sheet P1, which floats while it is moving in a direction opposite to the sheet feeding direction, bumps against the end fence 24.

Figure 22:
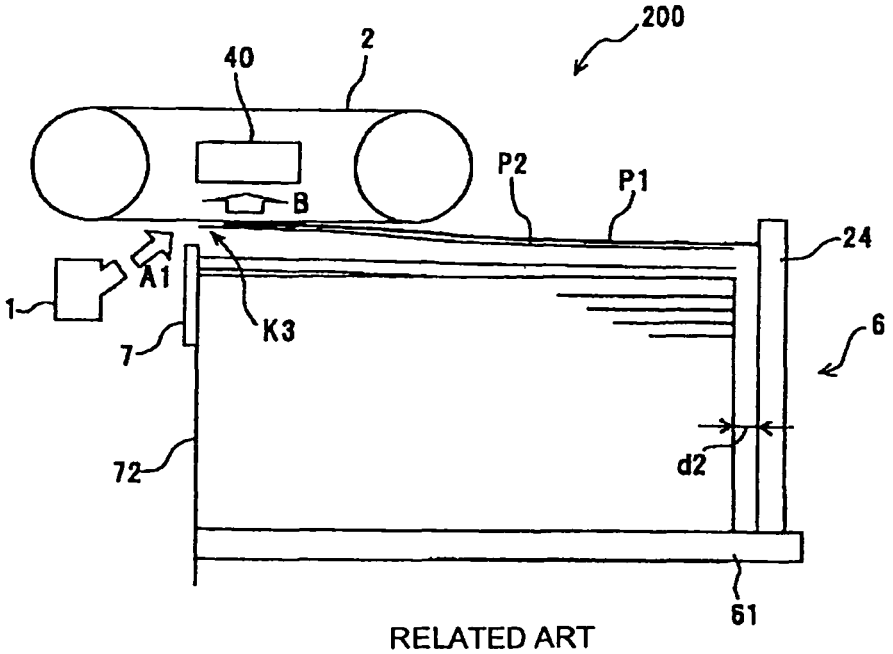
FIG. 22 is a view illustrating a state where the top sheet and the next top sheet are sucked onto a suction belt while the top sheet and the next top sheet are misaligned with each other in a sheet feeding direction in the feeding device in the related art.

In this case, the front end portion of the next top sheet P2 protrudes more than the front end portion of the top sheet P1 in the sheet feeding direction due to the appropriate clearance d2. If floating air and a suction force by the upper surface suction unit 40 are exerted on the front end portion of the next top sheet P2 in this state, the top sheet P1 and the next top sheet P2 are both sucked onto the suction belt 2 while being misaligned with each other in the sheet feeding direction as shown by an arrow K3 of FIG. 22. If the surface of the suction belt 2 is moved while the two sheets P that are superposed onto each other with a positional deviation therebetween in the sheet feeding direction and are sucked onto the suction belt 2 as shown in FIG. 22, the next top sheet P2 is also conveyed together with the top sheet P1. As a result, double feeding occurs.

In regard to the double feeding that is caused by the floating of sheets P while the sheets P move in a direction opposite to the sheet feeding direction as described above, it was necessary to make the end fence 24 closer to the sheets P as much as possible or to prevent the retreat of the sheet P with the use of a leaf spring or the like of which pressing pressure is low not to obstruct the floating of the sheet P.

If double feeding occurs, sheets P are unnecessarily consumed and blank sheets are mixed in printouts, resulting that the quality of a feeding device may significantly deteriorate.

The feeding device 200 according to this embodiment, which is shown in FIGS. 1A and 1B and FIGS. 3 to 5, includes the lower suction unit 18 that sucks air from the suction nozzle 34, so that the blowing of floating air by the floating nozzles 31, the suctioning by the upper surface suction unit 40, and the suctioning by the lower suction unit 18 are simultaneously performed (hereinafter, the air sucked by the suction nozzle 34 is referred to as suction air).

When floating air is blown from the floating nozzle 31, a plurality of sheets P positioned near the top sheet P1 of the bundle of sheets P stacked in the sheet-feed tray 6 float and the top sheet P1 is sucked onto the suction belt 2 by the suction of the upper surface suction unit 40. At the same time as this, air near the sheet blocking member 7 is sucked through the suction nozzle 34. As a result, the action of floating air is lost near the middle portions of the front ends of the next top sheet P2 and other sheets P that are positioned below the next top sheet P2. Accordingly, the middle portions of the next top sheet P2 and other sheets P which are positioned below the next top sheet P2 may reliably sag down to be lower than the end portions thereof in the width direction as shown by a broken line of FIG. 1A or as shown in FIG. 1B. Therefore, the top sheet P1 is reliably separated from the next top sheet P2. As a result, it may be possible to prevent double feeding that is caused by separation failure.

Further, since a sheet is made to float in a manner such that the sheet is attracted to the suction belt 2 by the suction of air around the middle portion of the front end of the sheet, and the sheet bumps against the sheet blocking member 7 at the front end thereof, it may be possible to prevent the sheets below the floating top sheet P2 from being caused to float while they move in a direction opposite to the sheet feeding direction after the top sheet P1 is sucked onto the suction belt 2. For this reason, as described with reference to FIG. 22, it may be possible to prevent the top sheet P1 and the next top sheet P2 from being sucked together onto the suction belt 2 while the top sheet P1 and the next top sheet P2 are not aligned with each other in the sheet feeding direction. Accordingly, it may be possible to prevent double feeding that is caused by the floating of sheets while the sheets P are moving in a direction opposite to the sheet feeding direction.

As described above, the feeding device 200 according to this embodiment can prevent double feeding that is caused by separation failure or double feeding that is caused by the floating of sheets while the sheets P are moving in a direction opposite to the sheet feeding direction. Accordingly, the feeding device according to the first embodiment can more reliably prevent the occurrence of double feeding as compared with the feeding device in the related art.

Figure 1A:
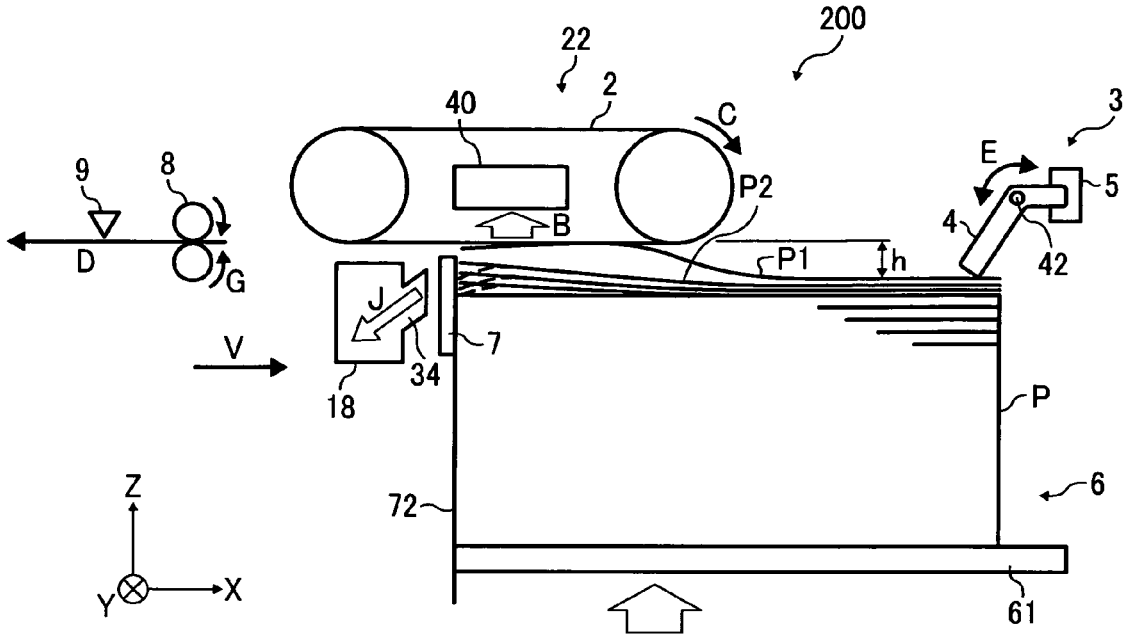
FIG. 1 is a schematic view showing the structure of a feeding device according to one embodiment.
Figure 1B:
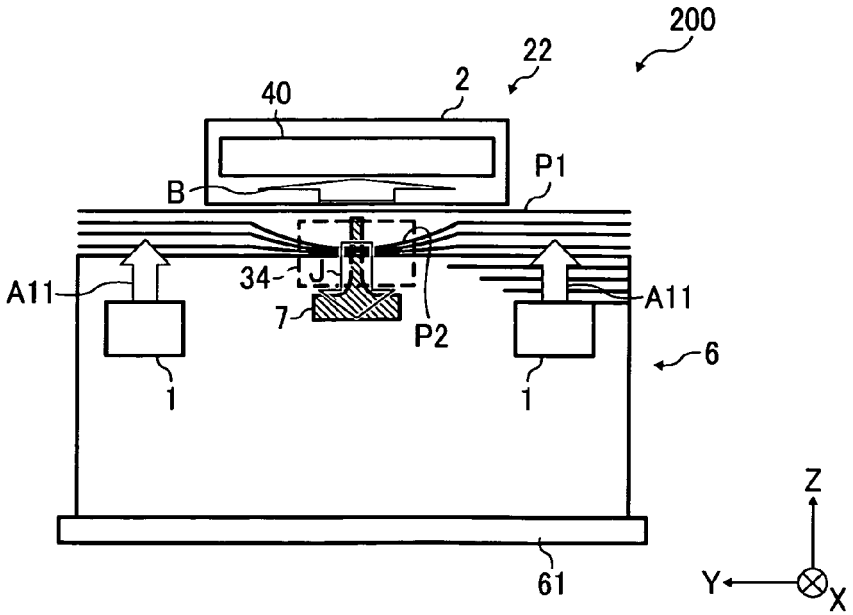

Further, in the feeding device 200 shown in FIGS. 1A and 1B, the sheet blocking member 7 is mounted on the sheet-feed tray 6 that can be pulled out from the body of the feeding device 200, and the suction nozzle 34 is mounted on the body of the feeding device 200 together with the lower suction unit 18. Since the sheet-feed tray 6 is pulled out from the feeding device 200 for the purpose of the replacement and supply of sheets P, the position of the suction nozzle 34 is changed relative to the position of the sheet blocking member 7. Accordingly, in the feeding device 200 according to this embodiment, in order to prevent breakage, an appropriate clearance is provided between the suction nozzle 34 and the sheet blocking member 7 so that the suction nozzle 34 and the sheet blocking member 7 do not interfere with each other.

Figure 6A:
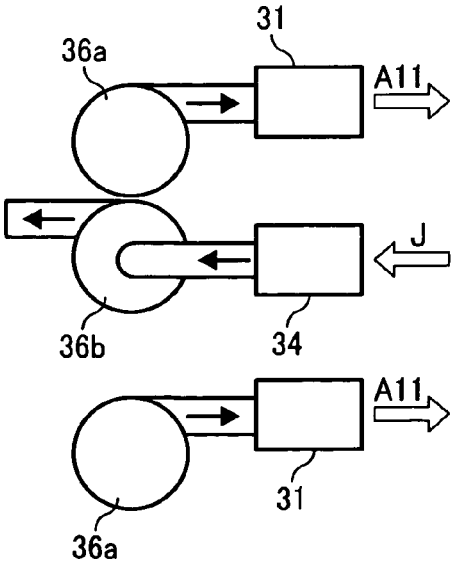
Figure 6B:
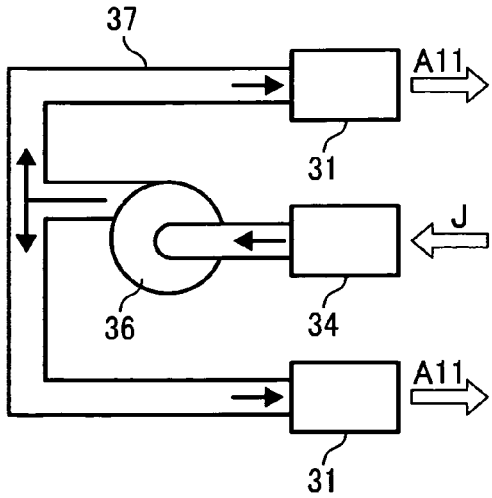

Next, FIGS. 6A and 6B show examples of the disposition of a blower 36 as an air current generating means, which generate floating air and suction air by blowing floating air from two floating nozzles 31 and sucking suction air from one suction nozzle 34.

FIG. 6A is a view showing the structure that includes two floating blowers 36*a* connected to two floating nozzles 31 and a lower suction blower 36*b* connected to a suction nozzle 34. FIG. 6B is a view showing the structure that blows floating air and sucks suction air by one blower 36.

The structure shown in FIG. 6A includes three blowers 36 as air current generating means, that is, one lower suction blower 36*b* for generating suction air (an arrow J in FIG. 6A) and two floating blowers 36*a* for generating floating air (arrows A11 in FIG. 6A).

Meanwhile, in the structure shown in FIG. 6B, the blower 36 connected to the suction nozzle 34 and the floating nozzles 31 are connected to a duct 37. According to this structure, it may be possible to generate the flow of air which is sucked through the suction nozzle 34 as suction air by the blower 36; and the flow of air which is blown out from the floating nozzle 31 as floating air. Accordingly, since it may be possible to generate suction air and floating air by one blower 36, it may be possible to reduce the number of parts and costs.

In addition, since it may be possible to form the circulating flow of air by performing the blowing and suction of air by one air current generating means, it may be possible to stably maintain a state where the sheets P float and are separated from each other.

In the structure shown in FIG. 6B, one blower 36 serves as both of the blowing unit 1 and the lower suction unit 18.

Meanwhile, the air current generating means is not limited to a blower. Any device, which can generate air current, such as a fan motor may be used as the air current generating means.

Modification 1

Next, a first modification (hereinafter, referred to as Modification 1) of the feeding device 200 according to this embodiment will be described.

Figure 7A:
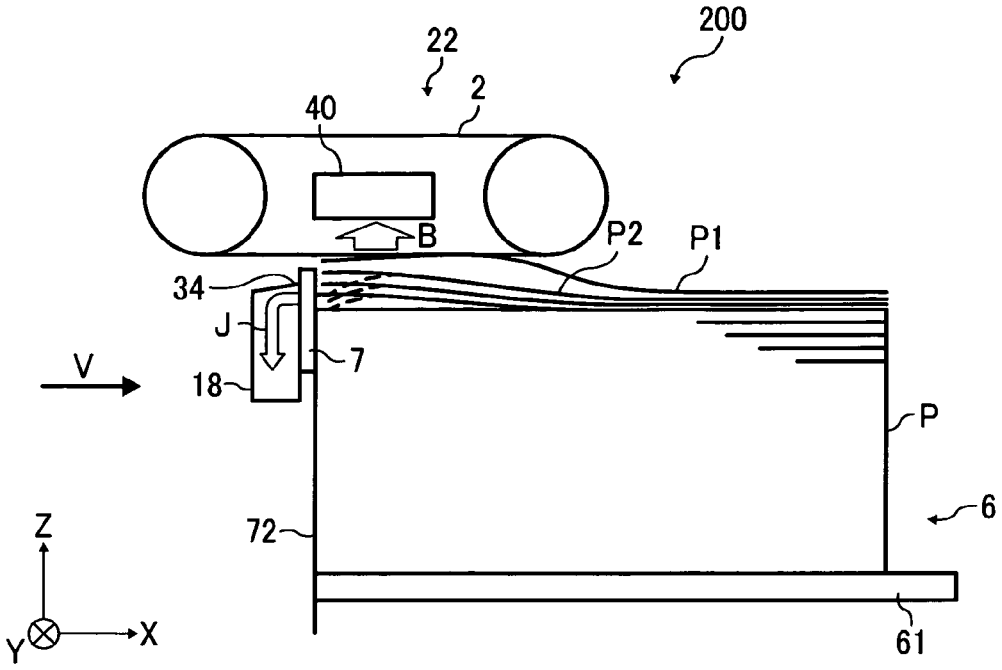
Figure 7B:
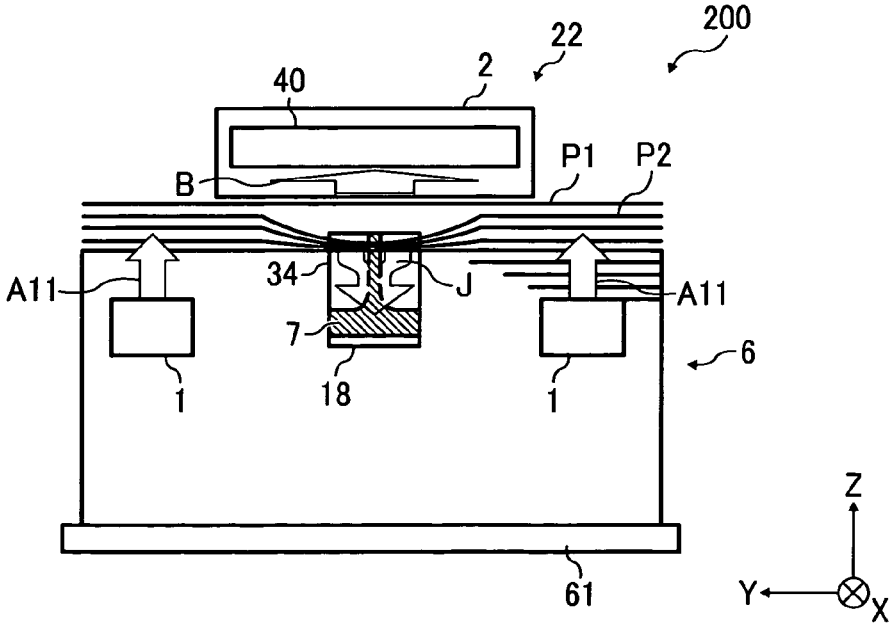

FIGS. 7A and 7B are schematic views showing the structure of a feeding device 200 according to Modification 1. FIG. 7A is a side view of the feeding device 200 according to Modification 1, and FIG. 7B is a front view of the feeding device 200 according to Modification 1 when the feeding device 200 is seen in a direction of an arrow V of FIG. 7A. Further, FIG. 8 is an enlarged perspective view showing the vicinity of the suction nozzle 34 of the sheet-feed tray 6 when the sheet feeding unit 22 is removed from the feeding device 200 according to Modification 1.

Figure 8:
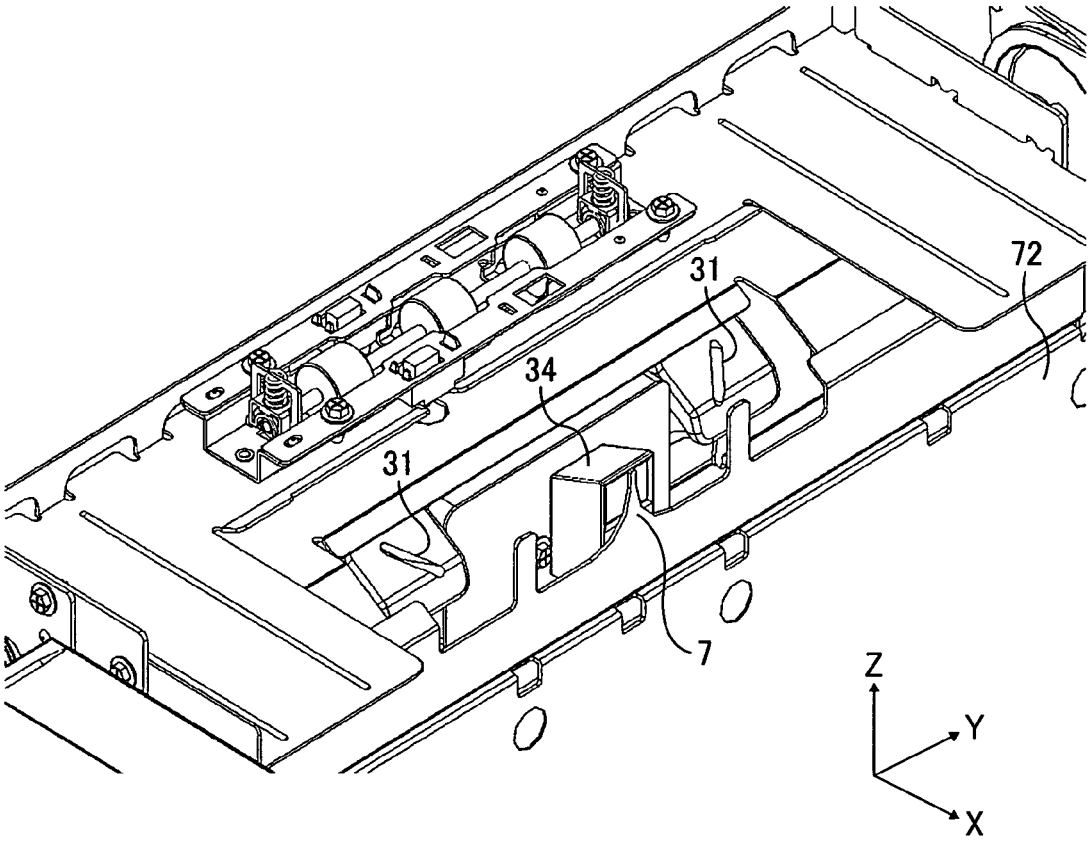
FIG. 8 is an enlarged perspective view showing the vicinity of a suction nozzle of the feeding device according to Modification 1.

As shown in FIGS. 7A, 7B, and 8, in the feeding device 200 according to Modification 1, the lower suction unit 18 is mounted on the sheet-feed tray 6 and the suction nozzle 34 comes into contact with the sheet blocking member 7. Since the lower suction unit 18 is mounted on the sheet-feed tray 6, it may be possible to make the suction nozzle 34 come into contact with the sheet blocking member 7, without changing the position of the suction nozzle 34 relative to the position of the sheet blocking member 7 when the sheet-feed tray 6 is pulled out. Further, since the suction nozzle 34 is disposed so as to come into contact with the sheet blocking member 7, it is not necessary to keep a clearance between the sheet blocking member 7 and the suction nozzle 34. Accordingly, it may be possible to efficiently suck air near the sheet blocking member 7.

Modification 2

Next, a second modification (hereinafter, referred to as Modification 2) of the feeding device 200 according to this embodiment will be described.

Figure 9A:
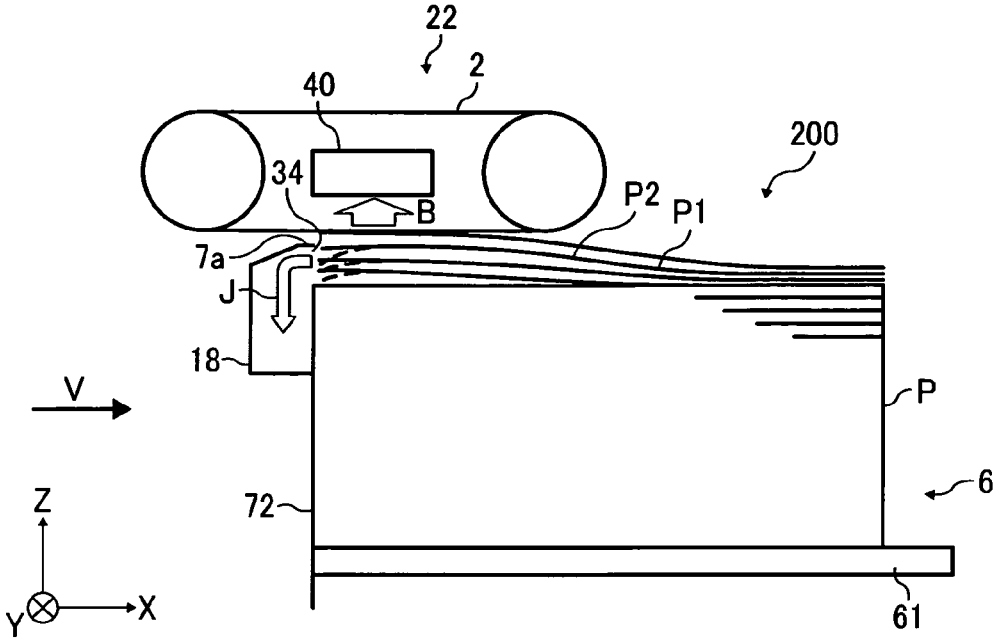
Figure 9B:
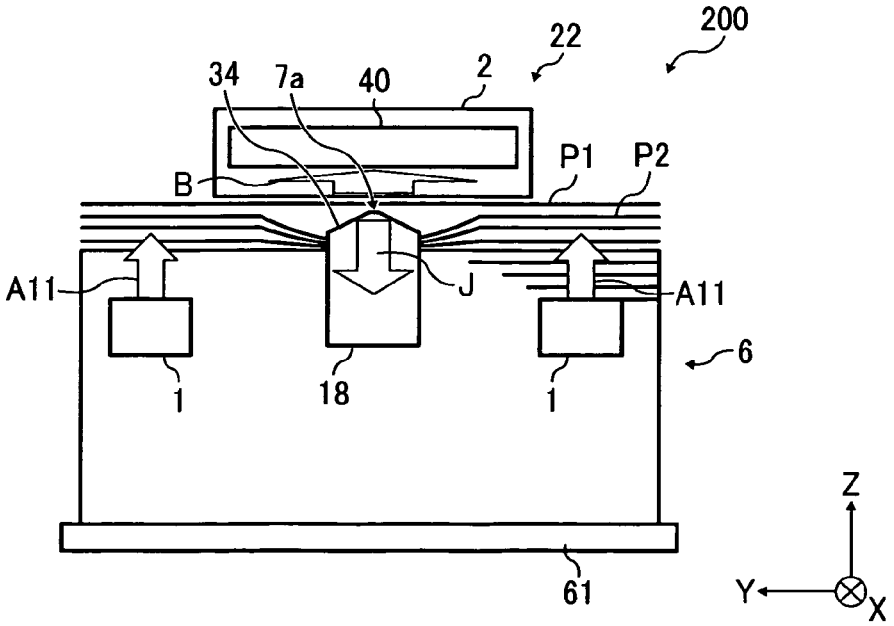

FIGS. 9A and 9B are schematic views showing the structure of a feeding device 200 according to Modification 2. FIG. 9A is a side view of the feeding device 200 according to Modification 2, and FIG. 9B is a front view of the feeding device 200 according to Modification 2 when the feeding device is seen in a direction of an arrow V of FIG. 9A. Further, FIG. 10 is an enlarged perspective view showing the vicinity of the suction nozzle 34 of the sheet-feed tray 6 when the sheet feeding unit 22 is removed from the feeding device 200 according to Modification 2.

Figure 10:
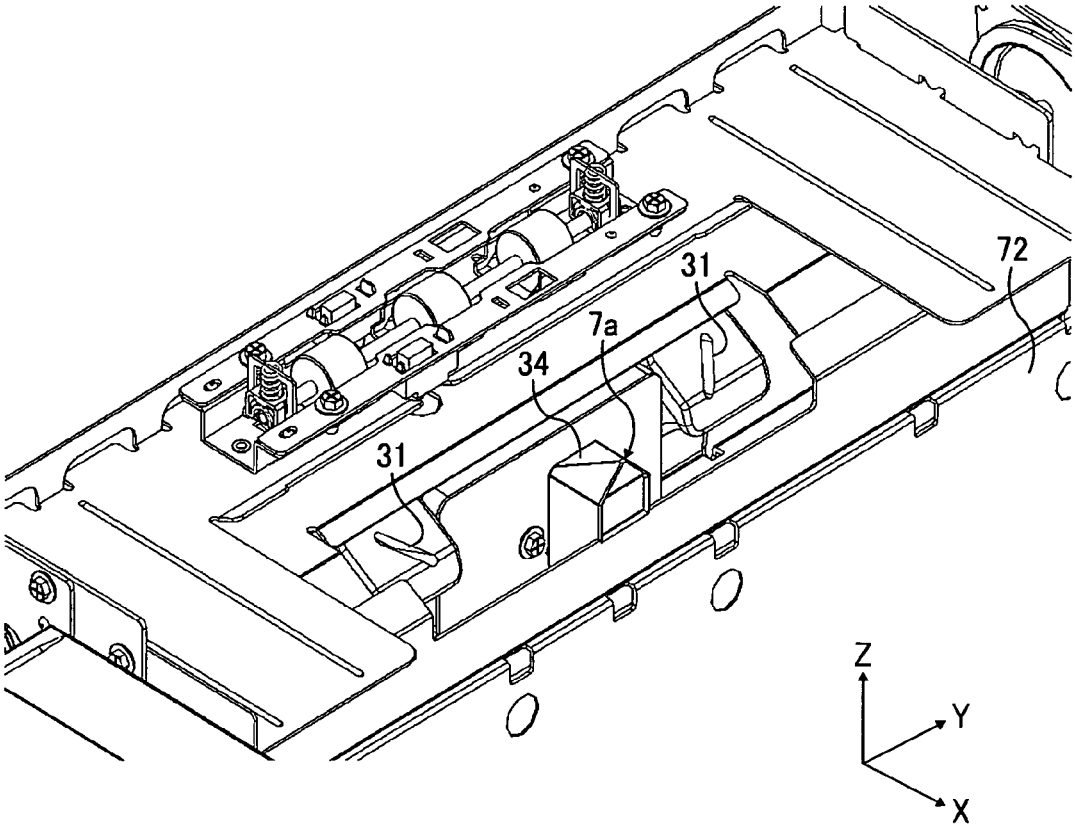
FIG. 10 is an enlarged perspective view showing the vicinity of a suction nozzle of the feeding device according to Modification 2.

As shown in FIGS. 9A, 9B and 10, in the feeding device 200 according to Modification 2, the lower suction unit 18 is mounted on the sheet-feed tray 6, and the upper end portion of the suction nozzle 34 protrudes upward from the sheet-feed tray 6 so as to serve as a sheet blocking portion 7*a*.

In the feeding device 200 according to Modification 2, the sheet blocking portion 7*a* is formed as part of the suction nozzle 34. That is, the suction nozzle 34 is formed integrally with the sheet blocking portion 7*a*. Accordingly, the feeding device 200 according to Modification 2 does not include the sheet blocking member 7 as a discrete form in comparison with other structures. Accordingly, a clearance between the suction nozzle 34 and the front end portions of sheets is eliminated so that the sheet blocking portion does not interfere with the flow passage of suction air; and it may be possible to more efficiently suck air near the middle portions of front ends of the floating sheets P.

Further, since the suction nozzle 34 is formed integrally with the sheet blocking portion, it may be possible to reduce the number of parts. As a result, it may be possible to reduce costs.

Furthermore, regarding the sheet blocking member 7, many of sheet blocking members having structures different from the above are formed of a metal plate in many cases. However, the sheet blocking portion may be formed integrally with the suction nozzle 34 and may be formed of a resin, an elastic member, or the like. If the sheet blocking portion is formed of a resin, an elastic member, or the like, it may be possible to suppress damage to the sheet P even though sheets P are rubbed against the suction nozzle 34.

As described above, the feeding device 200 according to this embodiment includes the sheet-feed tray 6 that is a sheet material housing; the upper surface suction unit 40 that is an upper surface suction means; and the sheet feeding unit 22 that is a sheet conveying means. A plurality of sheets P, which are sheet materials, can be substantially horizontally stacked in the sheet-feed tray 6. The upper surface suction unit 40 sucks air to attract the top sheet P1 thereto by generating negative pressure at a position facing the upper surface of the top sheet P1 that is a top sheet material positioned at the top of the sheets P stacked in the sheet-feed tray 6. Further, the sheet feeding unit 22 causes the top sheet P1, which is attracted by the upper surface suction unit 40, to be sucked onto the suction belt 2 that is a conveying member; and conveys the top sheet to the image forming section 101 that corresponds to the next process. The feeding device 200 having the above-mentioned structure includes the lower suction unit 18. The lower suction unit 18 is a lower suction means for exerting a suction force, which is directed downward, on the sheets P that are stacked in the sheet-feed tray 6 and positioned near the top sheet P1.

Here, a suction force, which is exerted on the top sheet P1 by the suction of the lower suction unit 18, is smaller than a suction force that is exerted on the top sheet P1 by the suction operation of the upper surface suction unit 40. Accordingly, when the upper surface suction unit 40 and the lower suction unit 18 are operating, the top sheet P1 is attached up onto the suction belt 2. Here, when the next top sheet P2, which is stacked under the top sheet P1 of sheets P, adheres to the top sheet P1 and is sucked onto the suction belt 2, the suction force of the lower suction unit 18 is exerted on the next top sheet P2 positioned below the top sheet P1. In this case, since the suction force of the upper surface suction unit 40 is exerted on the top sheet P1 and is not nearly exerted on the sheets P positioned below the top sheet P1, only the suction force of the lower suction unit 18 is exerted on the next top sheet P2 positioned below the top sheet P1. Since the suction force of the lower suction unit 18 is larger than the adhesion between the sheets P, the next top sheet P2 overlapped with the top sheet P1 is lifted down by the suction force of the lower suction unit 18; and only the top sheet P1 is sucked onto the conveying member. Accordingly, it may be possible to more reliably feed only the single top sheet P1.

Further, when the lower suction unit 18 sucks air at a position near the sheet blocking member 7 where the suction nozzle 34 is disposed, the action of floating air is lost at the middle portions of the front ends of the next top sheet P2 and the other sheets P, which are positioned below the next top sheet P2 and float, as shown by a broken line of FIG. 1A or as shown in FIG. 1B. Accordingly, the middle portions in width direction of the next top sheet P2 and the other sheets P, which are positioned below the next top sheet P2, reliably come to sag to be lower than the end portions thereof in the width direction as shown by a broken line of FIG. 1A or as shown in FIG. 1B. Therefore, the top sheet P1 and the next top sheet P2 are reliably separated from each other. As a result, it may be possible to prevent double feeding that is caused by separation failure.

In addition, the sheets P bump against the sheet blocking member 7 due to the suction of air by the suction nozzle 34. Accordingly, it may be possible to prevent the floating of the sheets P while the sheets P are moved in a direction opposite to the sheet feeding direction; and to prevent the top sheet P1 and the next top sheet P2 from being sucked onto the suction belt 2 and conveyed while the top sheet P1 and the next top sheet P2 overlap each other in a misaligned state. Therefore, it may be possible to prevent double feeding that is caused by the floating of sheets while the sheets P are moved in a direction opposite to the sheet feeding direction.

As described above, the feeding device 200 according to this embodiment can prevent double feeding that is caused by separation failure or double feeding that is caused by the floating of sheets while the sheets P are moved in a direction opposite to the sheet feeding direction. Accordingly, the feeding device according to the first embodiment can more reliably prevent the occurrence of double feeding as compared with the feeding device in the related art.

Further, the lower suction unit 18 of the feeding device 200 sucks air around the front end portions of the sheets P which are positioned near the top sheet P1 that is about to float by a suction force by the upper surface suction unit 40, so that the sheets P are pinned down. Accordingly, the middle portions in the width direction of the next top sheet P2 and the other sheets P, which are positioned below the next top sheet P2, come to sag to be lower than the end portions thereof in the width direction as shown by a broken line of FIG. 1A or as shown in FIG. 1B. Therefore, the top sheet P1 is reliably separated from the next top sheet P2 and other sheets P that are positioned below the next top sheet P2. As a result, it may be possible to convey only the single top sheet P1 that is sucked onto the suction belt 2.

Furthermore, the feeding device 200 according to this embodiment includes a sheet blocking member 7 that is a sheet material blocking member. When the sheet feeding unit 22 conveys the top sheet P1, if sheets P1, which are stacked in the sheet-feed tray 6 but do not include the top sheet P1, start to be conveyed together with the top sheet P1, the sheet material blocking member blocks the sheets P except for the top sheet P1. Since the front ends of the sheets P bump against the sheet blocking member 7, a fine adjustment of making the end fence 24 closer to the rear ends of the sheets P as much as possible is not needed. In addition, the positions of the front ends of any sheets P are always aligned with each other in the sheet feeding direction, so that it may be possible to improve the conveyance quality of sheets P.

Moreover, in the feeding device 200 according to Modification 1, the suction nozzle 34, which is a suction portion of the lower suction unit, is disposed so as to come into contact with the sheet blocking member 7. Thanks to this structure, a clearance may not need to be kept between the suction nozzle 34 and the sheet blocking member 7. Accordingly, it may be possible to efficiently suck air near the sheet blocking member 7.

Further, in the feeding device 200 according to Modification 2, a protruding portion is formed at the upper portion of the suction nozzle 34 that is a suction portion of the lower suction unit, and the protruding portion is formed as the sheet blocking portion 7*a*. Since the suction nozzle 34 is formed integrally with the sheet blocking portion as described above, a sheet blocking member 7 does not need to be formed. Accordingly, with this, it is allowable that no clearance is set between the suction nozzle 34 and the front ends of sheets P; and the sheet blocking portion does not interfere with the flow passage of suction air. Accordingly, it may be possible to more efficiently suck air near the middle portions of front ends of the floating sheets P.

Further, since the suction nozzle 34 is formed integrally with the sheet blocking portion, it may be possible to reduce the number of parts. As a result, it may be possible to reduce costs.

Furthermore, many of sheet blocking members 7 having structures different from the above are formed of a metal plate in many cases. However, the sheet blocking portion may be formed integrally with the suction nozzle 34 and may be formed of a resin, an elastic member, or the like. If the sheet blocking portion is formed of a resin, an elastic member, or the like, it may be possible to suppress damage to the sheet P even though sheets P are rubbed against the suction nozzle 34.

Moreover, the feeding device 200 according to this embodiment includes the blowing units 1 that are air discharge means. The blowing units cause the front end portions of the top sheet P1 and other sheets P which are positioned near the top sheet P1, to float and separate the plurality of sheets P positioned near the top sheet P1 by blowing air to the front end portions of the sheets P that are positioned near the top sheet P1 of the sheets P stacked in the sheet-feed tray 6. Air is blown to both end portions, in the width direction, of the front end of each sheet P positioned near the top sheet P1 of the sheets P stacked in the sheet-feed tray 6 by the blowing units 1. The blowing units 1 cause both ends of the front end portions of the top sheet P1 and other sheets P, which are positioned near the top sheet P1, in the width direction, to float and separate the plurality of sheets P positioned near the top sheet P1 by blowing air. Thanks to this structure, the feeding device 200 may be possible to regulate sheets P by blowing air and separate and convey sheets P by making the top sheet P1 be sucked onto the suction belt 2. The suction belt 2 conveys the only single sheet P that is separated from the others by the blowing and suction of air. Accordingly, the feeding device can cope with high linear speed and high productivity as compared with a friction separation type feeding device that separates a sheet by friction.

Further, like the structure shown in FIG. 6B, the suction of air from the suction nozzle 34, and the blowing of air from the floating nozzles 31 (which is to cause both ends of the front end portions of the top sheet P1 and sheets P, which are positioned near the top sheet P1, in the width direction, float) may be performed by one blower 36. In the structure shown in FIG. 6A, one lower suction blower 36*b* for sucking air and two floating blowers 36*a* for blowing air, that is, three blowers 36 are used. In contrast, according to the structure shown in FIG. 6B, the suction and blowing of air can be performed by only the single blower 36 that is an air current generating unit. Accordingly, it may be possible to reduce the number of parts. As a result, it may be possible to reduce costs.

In addition, since it may be possible to form the circulating flow of air by performing the blowing and suction of air by one air current generating means, it may be possible to stably maintain a state where the sheets P float and are separated from each other.

Further, the feeding device 200 includes the sheet upper surface sensor 3 that is a sheet upper surface position detecting means for detecting the height of the upper surface of the top sheet P1; the bottom plate 61 that supports the lower surface of the bundle of sheets P stacked in the sheet-feed tray 6; and the lifting mechanism 150 that moves the bottom plate 61 up and down. Furthermore, the feeding device includes a lifting control means (not shown). The lifting control means controls the operation of the bottom plate lifting motor M1 of the lifting mechanism 150 on the basis of the detection result of the sheet upper surface sensor 3 so that the height of the upper surface of the top sheet P1 of the sheets P supported on the bottom plate 61 becomes a predetermined height. Accordingly, even though the number of the sheets P stacked in the sheet-feed tray 6 decreases by the feeding of sheets, it may be possible to keep the distance h between the top sheet P1 and the lower surface of the suction belt 2 in a constant range, and to stably feed sheets.

Moreover, the copying machine 100, which is an image forming apparatus according to this embodiment, includes the image forming section 101 and the feeding device 200. The image forming section 101 forms an image on a sheet P serving as a sheet material that is a recording medium. The feeding device 200 is a sheet material feeding means for feeding a sheet P to the image forming section 101. Since the feeding device 200 is used as the sheet material feeding means, the double feeding of various types of sheets, for example, from a thin sheet to a thick sheet, may be avoided even in the case of using a sheet feeding means making use of the suction belt 2. Accordingly, the deterioration of the quality of the copying machine 100, that is, the unnecessary consumption of sheets P or the mixing of blank sheets in printouts does not occur. Further, a time required to deal with a trouble such as a jam is reduced due to the prevention of double feeding. Accordingly, it may be possible to improve the quality of the image forming apparatus.

According to the invention, it may be possible to more reliably feed only the top sheet material. Accordingly, it may be possible to obtain advantages of more reliably suppressing double feeding and stably feeding a sheet material.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A feeding device comprising:

a sheet material housing configured to allow a plurality of sheet materials to be stacked;

an upper surface suction unit configured to suck a top sheet material which is positioned at the top of sheet materials stacked in the sheet material housing by generating negative pressure at a position facing an upper surface of the top sheet material;

a sheet material conveying unit that causes the top sheet material, which is sucked by the upper surface suction unit, to be sucked onto a conveying member and conveys the top sheet material to a subsequent process;

a lower suction unit that exerts a downward suction force on only a central portion of the sheet materials other than the top sheet material that are stacked in the sheet material housing; and at least one air discharge unit configured to cause lateral side portions of the top sheet material and lateral side portions of each of other sheet materials positioned near the top sheet material to be concurrently floated higher than the central portion of the sheet materials other than the top sheet material that are stacked in the sheet material housing by blowing air to each of a plurality of lateral side portions of the sheet materials that are positioned near the top sheet material of the sheet materials stacked in the sheet material housing concurrently, wherein a downward suction force which is exerted on the top sheet material by suction of the lower suction unit is smaller than a suction force which is exerted on the top sheet material by suction of the upper surface suction unit and is larger than an adhesive force between the sheet materials, the lower suction unit is configured to suck a front end portion of a plurality of the sheet materials, which are positioned near the top sheet material, downward concurrently, while the top sheet material being sucked by the upper surface suction unit so as to just start to float upward and while portions lateral to the central portion are being blown upwardly by the at least one air discharge unit, and the lower suction unit is directly connected to a suction nozzle located on a front wall of the sheet material housing facing the front end portion of the sheet materials and between air discharge nozzles located on the front wall and connected to the at least one air discharge unit.

2. The feeding device according to claim 1, further comprising:

a sheet material blocking member configured to block a leading edge of the sheet materials other than the top sheet material when the sheet material conveying unit conveys the top sheet material and when the sheet materials start to be conveyed together with the top sheet material.

3. The feeding device according to claim 2, wherein a suction portion of the lower suction unit is in contact with the sheet material blocking member, and a width of an opening of the suction portion is larger than a width of a portion of the sheet material blocking member that is in contact with the suction portion.

4. The feeding device according to claim 2, wherein a suction portion of the lower suction unit is formed integrally with the sheet material blocking member.

5. The feeding device according to claim 1, wherein air, which is sucked in by the lower suction unit, is discharged out from the air discharge unit.

6. The feeding device according to claim 1, further comprising:

a sheet upper surface position detecting unit that detects a height of the upper surface of the top sheet material;

a bottom plate that supports a lower surface of the sheet materials stacked in the sheet material housing;

a lifting unit that lifts the bottom plate up and down in a vertical direction; and a lifting control unit that controls an operation of the lifting unit so that the height of the upper surface of the top sheet material of the sheet materials supported on the bottom plate becomes a predetermined height, based on a detection result from the sheet upper surface position detecting unit.

7. An image forming apparatus comprising:

an image forming section that forms an image on a sheet material that is a recording medium; and a sheet material feeding unit that feeds the sheet material to the image forming section, wherein the feeding device according to claim 1 is used as the sheet material feeding unit.

8. The feeding device according to claim 3, wherein the sheet material blocking member covers at least a portion of the opening of the suction portion of the lower suction unit.

9. The feeding device according to claim 1, wherein the downward suction force of the lower suction unit is greater than sheet separation force of the at least one discharge unit.

* * * * *